US011802571B2

(12) United States Patent
Pouget et al.

(10) Patent No.: US 11,802,571 B2
(45) Date of Patent: Oct. 31, 2023

(54) FAN ASSEMBLY

(71) Applicant: Dyson Technology Limited, Wiltshire (GB)

(72) Inventors: Charles Edward Pouget, Swindon (GB); George Oram, Gloucester (GB); James Gregory Forrest, Bristol (GB); Steven Eduard Peet, Bristol (GB); Lyle Dempsey Fletcher-Wilmot, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 208 days.

(21) Appl. No.: 17/418,160

(22) PCT Filed: Dec. 17, 2019

(86) PCT No.: PCT/GB2019/053587
§ 371 (c)(1),
(2) Date: Jun. 24, 2021

(87) PCT Pub. No.: WO2020/141309
PCT Pub. Date: Jul. 9, 2020

(65) Prior Publication Data

US 2022/0074419 A1 Mar. 10, 2022

(30) Foreign Application Priority Data

Jan. 2, 2019 (GB) ..... 1900025
Sep. 12, 2019 (GB) ..... 1913181

(51) Int. Cl.
*F04D 25/10* (2006.01)
*F04D 29/54* (2006.01)

(52) U.S. Cl.
CPC ..... *F04D 25/10* (2013.01); *F04D 29/545* (2013.01)

(58) Field of Classification Search
CPC ..... F04D 25/08; F04D 25/10; F04F 5/461
See application file for complete search history.

(56) References Cited

U.S. PATENT DOCUMENTS 2,488,467 A 11/1949 De Lisio
2010/0188654 A1 7/2010 Horio
(Continued)

FOREIGN PATENT DOCUMENTS

AU 2017265070 A1 * 6/2018 ..... F24F 13/06
AU 2017265070 A1 6/2018
(Continued)

OTHER PUBLICATIONS

Office Action received for Japanese Patent Application No. 2021-532045, dated May 24, 2022, 11 pages (6 pages of English Translation and 5 pages of Original Document).
(Continued)

*Primary Examiner* — David E Sosnowski
*Assistant Examiner* — Jackson N Gillenwaters
(74) *Attorney, Agent, or Firm* — Faegre Drinker Biddle & Reath LLP

(57) ABSTRACT

There is provided a fan assembly comprising an air flow generator that is arranged to generate an air flow through the fan assembly, and a nozzle arranged to emit the air flow from the fan assembly. The nozzle comprises a nozzle body and a plurality of steerable air outlets that are each arranged to emit a portion of the air flow, wherein the plurality of steerable air outlets are arranged to be independently rotated relative to the nozzle body.

16 Claims, 14 Drawing Sheets

(56) References Cited

U.S. PATENT DOCUMENTS

| | | | | |
|---|---|---|---|---|
| 2013/0028763 | A1* | 1/2013 | Staniforth | F24F 1/01 417/423.5 |
| 2013/0323100 | A1* | 12/2013 | Poulton | F04D 25/08 415/220 |
| 2014/0255173 | A1* | 9/2014 | Poulton | F04D 25/08 415/182.1 |
| 2016/0238039 | A1 | 8/2016 | Stewart et al. | |

FOREIGN PATENT DOCUMENTS

| | | | | |
|---|---|---|---|---|
| CN | 101793513 | A | | 8/2010 |
| CN | 107542692 | A | | 1/2018 |
| CN | 107542696 | A | | 1/2018 |
| CN | 212106397 | U | | 12/2020 |
| DE | 2933083 | A1 | | 2/1981 |
| GB | 2391846 | A | | 2/2004 |
| GB | 2568937 | A | | 6/2019 |
| GB | 2568938 | A | | 6/2019 |
| JP | 55-067399 | U | | 5/1980 |
| JP | 58-064930 | U | | 5/1983 |
| JP | 2013-113301 | A | | 6/2013 |
| JP | 2015-117643 | A | | 6/2015 |
| JP | 2017-009202 | A | | 1/2017 |
| JP | 2017009202 | A | * | 1/2017 |
| JP | 2017-198181 | A | | 11/2017 |
| JP | 2017198181 | A | * | 11/2017 |
| KR | 10-2017-0065327 | A | | 6/2017 |
| WO | 2010/100451 | A1 | | 9/2010 |
| WO | 2013/035271 | A1 | | 3/2013 |
| WO | 2013/076454 | A2 | | 5/2013 |
| WO | 2020/141309 | A1 | | 7/2020 |

OTHER PUBLICATIONS

International Preliminary Reporton Patentability received for PCT Patent Application No. PCT/GB2019/053587, dated Jul. 15, 2021, 7 pages.

Office Action received for Chinese Patent Application No. 202010001871.0, dated Jun. 25, 2021, 17 pages (9 pages of English Translation and 8 pages of Original Document).

International Search Report and Written Opinion dated Mar. 24, 2020, directed to International Application No. PCT/GB2019/053587; 9 pages.

Search Report dated Feb. 13, 2020, directed to GB Application No. 1913181.2; 1 page.

Search Report dated Jun. 25, 2019, directed to GB Application No. 1900025.6; 2 pages.

* cited by examiner

FAN ASSEMBLY

REFERENCE TO RELATED APPLICATIONS

This application is a national stage application under 35 U.S.C. 371 of International Application No. PCT/GB2019/053587, filed Dec. 17, 2019, which claims the benefit of United Kingdom Application No. 1900025.6, filed Jan. 2, 2019, and United Kingdom Application No. 1913181.2, filed Sep. 12, 2019, the entire contents of each of which are incorporated herein.

FIELD OF THE DISCLOSURE

The present invention relates to a fan assembly and a nozzle for a fan assembly

BACKGROUND OF THE DISCLOSURE

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows air flow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an air flow into the base, and a series of concentric, annular nozzles connected to the base and each comprising an annular outlet located at the front of the nozzle for emitting the air flow from the fan. Each nozzle extends about a bore axis to define a bore about which the nozzle extends.

Each nozzle is in the shape of an airfoil may therefore be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the air flow in a direction extending away from the nozzle and along the chord line.

Another fan assembly which does not use caged blades to project air from the fan assembly is described in WO 2010/100451. This fan assembly comprises a cylindrical base which also houses a motor-driven impeller for drawing a primary air flow into the base, and a single annular nozzle connected to the base and comprising an annular mouth/outlet through which the primary air flow is emitted from the fan. The nozzle defines an opening through which air in the local environment of the fan assembly is drawn by the primary air flow emitted from the mouth, amplifying the primary air flow. The nozzle includes a Coanda surface over which the mouth is arranged to direct the primary air flow. The Coanda surface extends symmetrically about the central axis of the opening so that the air flow generated by the fan assembly is in the form of an annular jet having a cylindrical or frusto-conical profile.

SUMMARY OF THE DISCLOSURE

It is an object of the present invention to provide a nozzle for a fan assembly that is capable of manipulating the direction of the air flow emitted from the nozzle without the need to oscillate the nozzle.

According a first aspect there is provided a fan assembly comprising an air flow generator that is arranged to generate an air flow through the fan assembly, and a nozzle arranged to emit the air flow from the fan assembly, the nozzle comprising a nozzle body and a plurality of steerable air outlets that are each arranged to emit a portion of the air flow. Each of the steerable air outlets comprises an opening within a corresponding outlet section of the nozzle body and an elongate outlet body that is arranged to substantially occlude (i.e. fill) the opening and that is arranged to rotate within the opening around a longitudinal axis of the outlet body, and each outlet body is provided with an air outlet channel that extends through a width of the outlet body. The air outlet channel allows air to flow out of the nozzle through the outlet body. The air flow generator may comprise a motor-driven impeller.

The plurality of steerable air outlets may be arranged to be independently rotated relative to the nozzle body Preferably, the steerable air outlets are arranged to be parallel with one another. Each outlet body may have an at least partially circular cross-section, and preferably is cylindrical in shape.

The air outlet channel of each outlet body may be straight and extend diametrically through the outlet body. An ingress end of each air outlet channel may be provided with a bell-mouth to assist with channeling air flowing into the air outlet channel Each outlet body may be arranged such that the ingress end of the air outlet channel is closer to the opening than an egress end of the air outlet channel.

Each of the steerable air outlets may further comprise a steering motor that is arranged to rotate the corresponding outlet body. Each outlet body may be attached to a shaft of the corresponding steering motor. The fan assembly may then further comprise a control circuit that is arranged to control the steerable air outlets. The control circuit may be arranged to independently control each steering motor (i.e. the steering motor of each of the steerable air outlets).

Each of the steerable air outlets may further comprise an outlet body orientation detection system that is arranged to detect the orientation of the outlet body relative to the nozzle body. The outlet body orientation detection system may be arranged to detect which one of two portions of a vectoring range the outlet body is currently in. The outlet body orientation detection system may comprise a photo-interrupter provided on the nozzle body and a screen that is arranged to be detected by the photo-interrupter when the outlet body is in one of the two portions of the vectoring range. The screen may project radially from a rotational axis of the outlet body and extends across/over one of the two portions of the vectoring range, and preferably extends across/over substantially one half of the vectoring range. The screen may have two edges that extend radially away from the rotational axis. The screen may then be arranged such that a first edge of the screen is detected/aligned with the photo-interrupter when the outlet body is orientated at a first end of the vectoring range. The screen may be arranged such that a second edge of the screen is detected/aligned with the photo-interrupter when the outlet body is between 0 and 10 degrees away from a mid-point of the vectoring range, and is preferably between 5 and 8 degrees away. The mid-point of the vectoring range may be aligned with a plane that longitudinally bisects the opening.

The nozzle body may comprise a casing that defines the outlet section of each of the steerable air outlets. Each outlet section may comprise an interior passage that is defined by the casing and that is arranged to convey air from an air inlet of the nozzle to the steerable air outlet.

The nozzle may comprises a first steerable air outlet and a second steerable air outlet. The nozzle body may then comprise a first outlet section that houses/contains the first steerable air outlet and a section outlet section that houses/contains the second steerable air outlet. The first steerable air outlet comprises a first opening defined by the first outlet section and a first outlet body that is disposed within the first opening and that is arranged to rotate within the first opening, and the second steerable air outlet comprises a second opening defined by the second outlet section and a second outlet body that is disposed within the second opening and that is arranged to rotate within the second opening The nozzle body may have an elongate annular shape and the first and second steerable air outlets may then each be located on a respective elongate side of the nozzle body. The nozzle body may define a correspondingly shaped central bore. The first and second steerable air outlets may then each be located on a respective elongate side of the central bore at the front of the nozzle.

The nozzle body may comprise two parallel, straight side sections each adjacent a respective elongate side of a central bore, an upper curved section joining the upper ends of the straight sections, and a lower curved section joining the lower ends of the straight sections. The nozzle body may comprise an elongate annular casing that extends around the central bore of the nozzle body and wherein the casing defines an interior passage that is arranged to convey air from an air inlet of the nozzle to the first and second steerable air outlets.

The fan assembly may further comprise a body housing the air flow generator, and wherein the body comprises an air inlet through which the air flow is drawn into the body by the air flow generator and an air outlet/vent downstream of the air flow generator for emitting the air flow from the body. The nozzle may then be mounted on the body over the air outlet. The nozzle may then be arranged to receive the air flow exhausted from the air outlet of the body.

The body may comprise a base for supporting the fan assembly on a surface. The air outlet of the body may then be provided at an upper end of the body and the nozzle mounted on the upper end of the body. The nozzle may comprise a neck/base that connects to the upper end of the body and has an open lower end which provides an air inlet for receiving the air flow from the body. The body may comprise an annular flange that surrounds the air outlet and the nozzle may then be supported on the annular flange. An outer edge of the annular flange may be substantially flush with an external surface of the base/neck of the nozzle that connects to upper end of the body.

According to a second aspect there is provided a nozzle for a fan assembly. The nozzle comprises an air inlet for receiving an air flow from the fan assembly, a nozzle body and a plurality of steerable air outlets that are each arranged to emit a portion of the air flow. Each of the steerable air outlets comprises an opening within a corresponding outlet section of the nozzle body and an elongate outlet body that is arranged to substantially occlude (i.e. fill) the opening and that is arranged to rotate within the opening around a longitudinal axis of the outlet body, and each outlet body is provided with an air outlet channel that extends through a width of the outlet body. The plurality of steerable air outlets may be arranged to be independently rotated relative to the nozzle body.

The nozzle may comprise a first steerable air outlet and a second steerable air outlet. The nozzle body may comprise a first outlet section that houses/contains the first steerable air outlet and a section outlet section that houses/contains the second steerable air outlet. The first steerable air outlet may comprise a first opening defined by the first outlet section and a first outlet body that is disposed within the first opening and that is arranged to rotate within the first opening, and the second steerable air outlet comprises a second opening defined by the second outlet section and a second outlet body that is disposed within the second opening and that is arranged to rotate within the second opening The nozzle body may have an elongate annular shape and the first and second steerable air outlets may then each be located on a respective elongate side of the nozzle body. The nozzle body may define a correspondingly shaped central bore. The first and second steerable air outlets may then each be located on a respective elongate side of the central bore at the front of the nozzle. The nozzle body may comprise two parallel, straight side sections each adjacent a respective elongate side of a central bore, an upper curved section joining the upper ends of the straight sections, and a lower curved section joining the lower ends of the straight sections.

There is also provided a fan assembly comprising an air flow generator that is arranged to generate an air flow through the fan assembly, and a nozzle arranged to emit the air flow from the fan assembly. The nozzle comprises a nozzle body and a plurality of steerable/maneuverable air outlets that are each arranged to emit a portion of the air flow, wherein the plurality of steerable air outlets are arranged to be independently rotated relative to the nozzle body. Each of the steerable air outlets comprises an opening within a corresponding outlet section of the nozzle body and an outlet body that is disposed within the opening and that is arranged to rotate within the opening. Each outlet body may be provided with an air outlet channel that extends through a width of the outlet body. The air outlet channel may allow air to flow out of the nozzle through the outlet body. Each outlet body may be arranged to substantially occlude (i.e. fill) the corresponding opening.

BRIEF DESCRIPTION OF THE FIGURES

An embodiment of the present invention will now be described, by way of example only, with reference to the accompanying drawings, in which.

DETAILED DESCRIPTION OF THE DISCLOSURE

There will now be described a fan assembly comprising a nozzle that is capable of manipulating the direction of the air flow emitted from the nozzle without the need to oscillate the nozzle. The term "fan assembly" as used herein refers to a fan assembly configured to generate and deliver an air flow for the purposes of thermal comfort and/or environmental or climate control. Such a fan assembly may be capable of generating one or more of a dehumidified air flow, a humidified air flow, a purified air flow, a filtered air flow, a cooled air flow, and a heated air flow.

The fan assembly comprises an air flow generator that is arranged to generate an air flow and a nozzle arranged to emit the air flow from the fan assembly, the nozzle comprising a nozzle body and a plurality of steerable/maneuverable air outlets that are each arranged to emit a portion of the air flow. The steerable air outlets are arranged to be independently rotated relative to the nozzle body such that a direction of the portion of the air flow emitted by each of the steerable air outlets can be varied without rotating the nozzle relative to any portion of the body. The term "air outlet" as used herein refers to a portion of the nozzle through which an air flow escapes from the nozzle. In particular, in the embodiments described herein, each air outlet comprises an air outlet channel through which an air flow exits the nozzle.

In a preferred embodiment, each of the steerable air outlets comprises an opening within a corresponding outlet section of the nozzle body and an outlet body that is disposed within the opening and that is arranged to rotate within the opening. Each outlet body is then provided with an air outlet channel that extends through a width of the outlet body and that allows air to flow out of the nozzle through the outlet body. Each outlet body is arranged to substantially occlude/fill the corresponding opening such that very little if any of the air within the nozzle can leak through any spaces between the outlet body and the corresponding opening.

Figure 1:
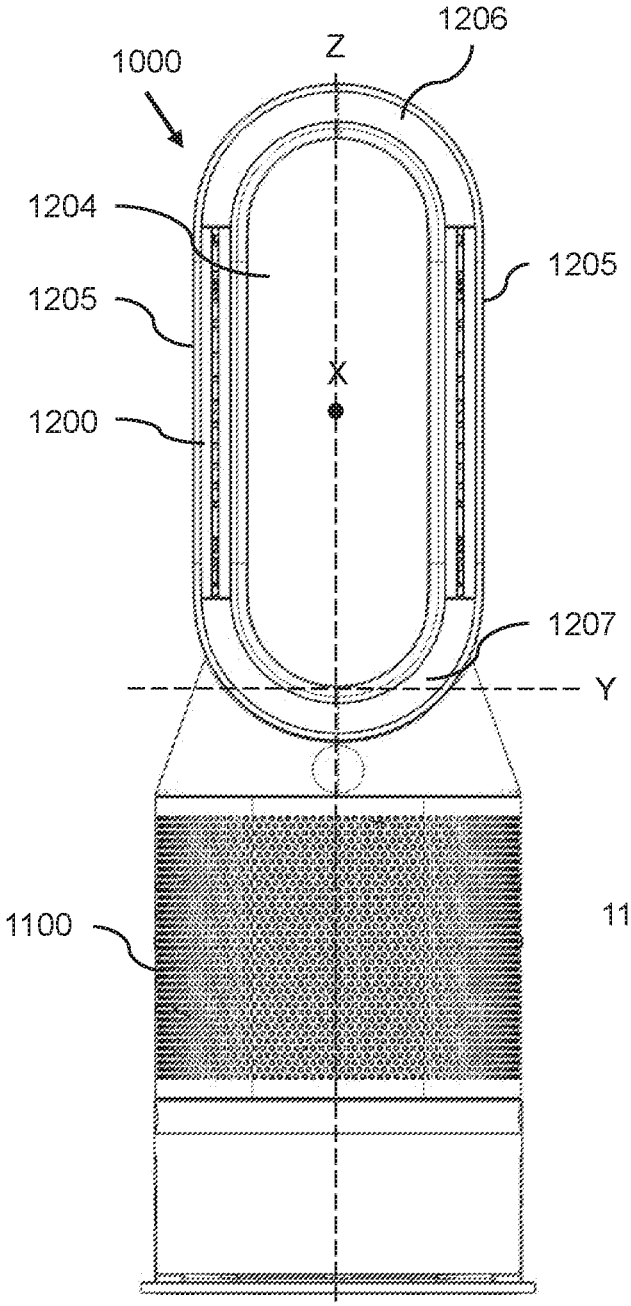
FIG. 1 is a front view of an embodiment of a fan assembly.
Figure 2:
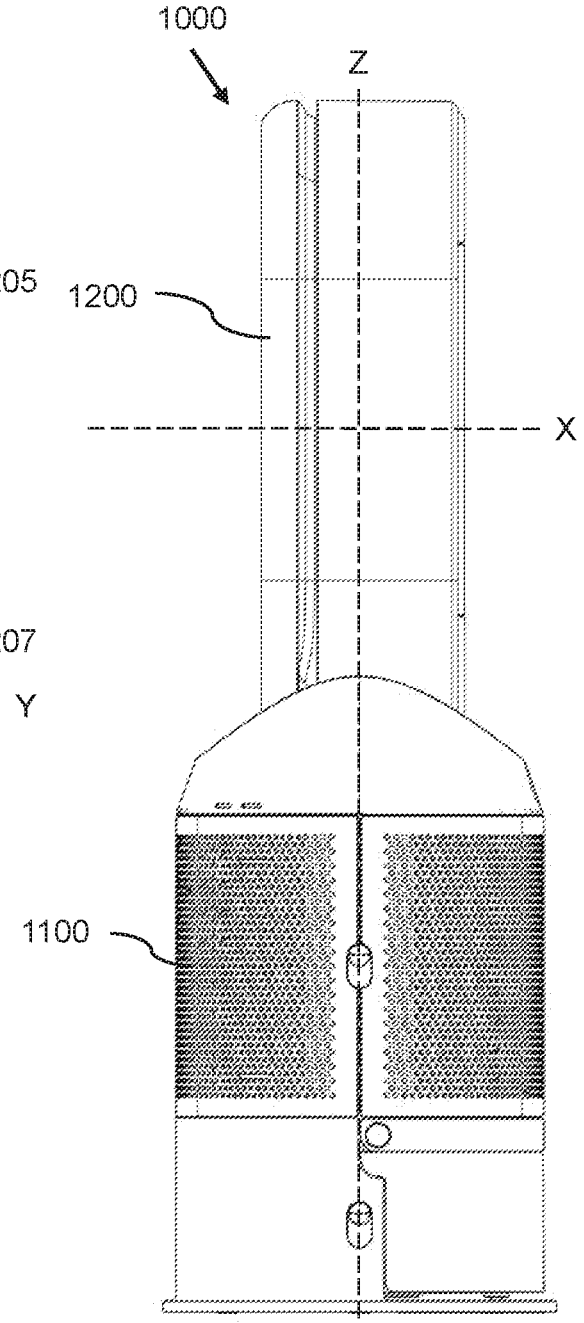
FIG. 2 is a left side view of the fan assembly of FIG. 1.
Figure 3:
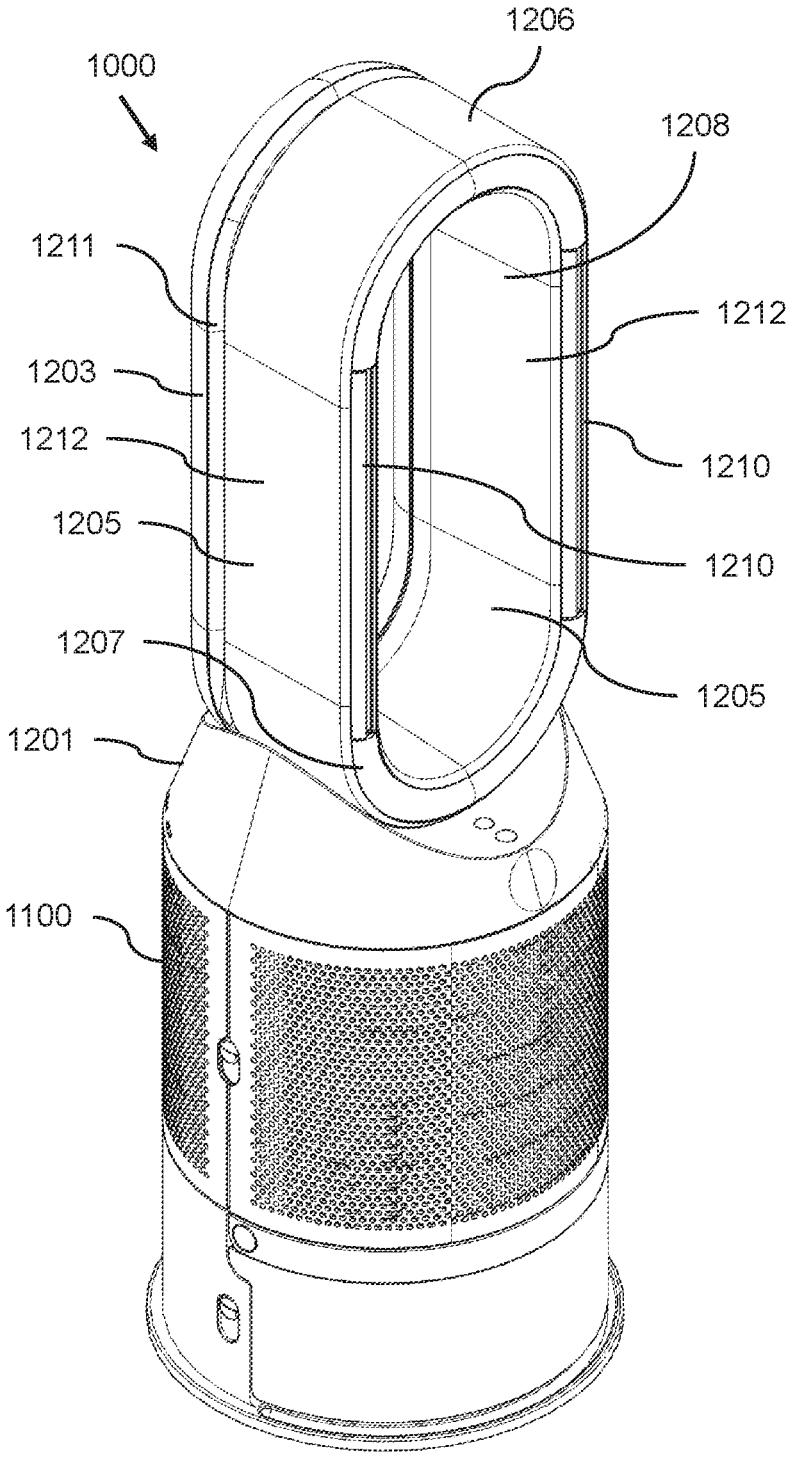
FIG. 3 is an isometric view of the fan assembly of FIG. 1.

FIGS. 1, 2 and 3 are external views of an embodiment of a fan assembly 1000. FIG. 1 shows a front view of the fan assembly 1000, FIG. 2 shows a side view of the fan assembly 1000 and FIG. 3 shows an isometric view of the fan assembly 1000. The fan assembly 1000 comprises a body or stand 1100 containing a motor-driven impeller that is arranged to generate an air flow through the fan assembly and a nozzle 1200 mounted on the body 1100, and which is arranged to emit the air flow from the fan assembly 1000.

Figure 4:
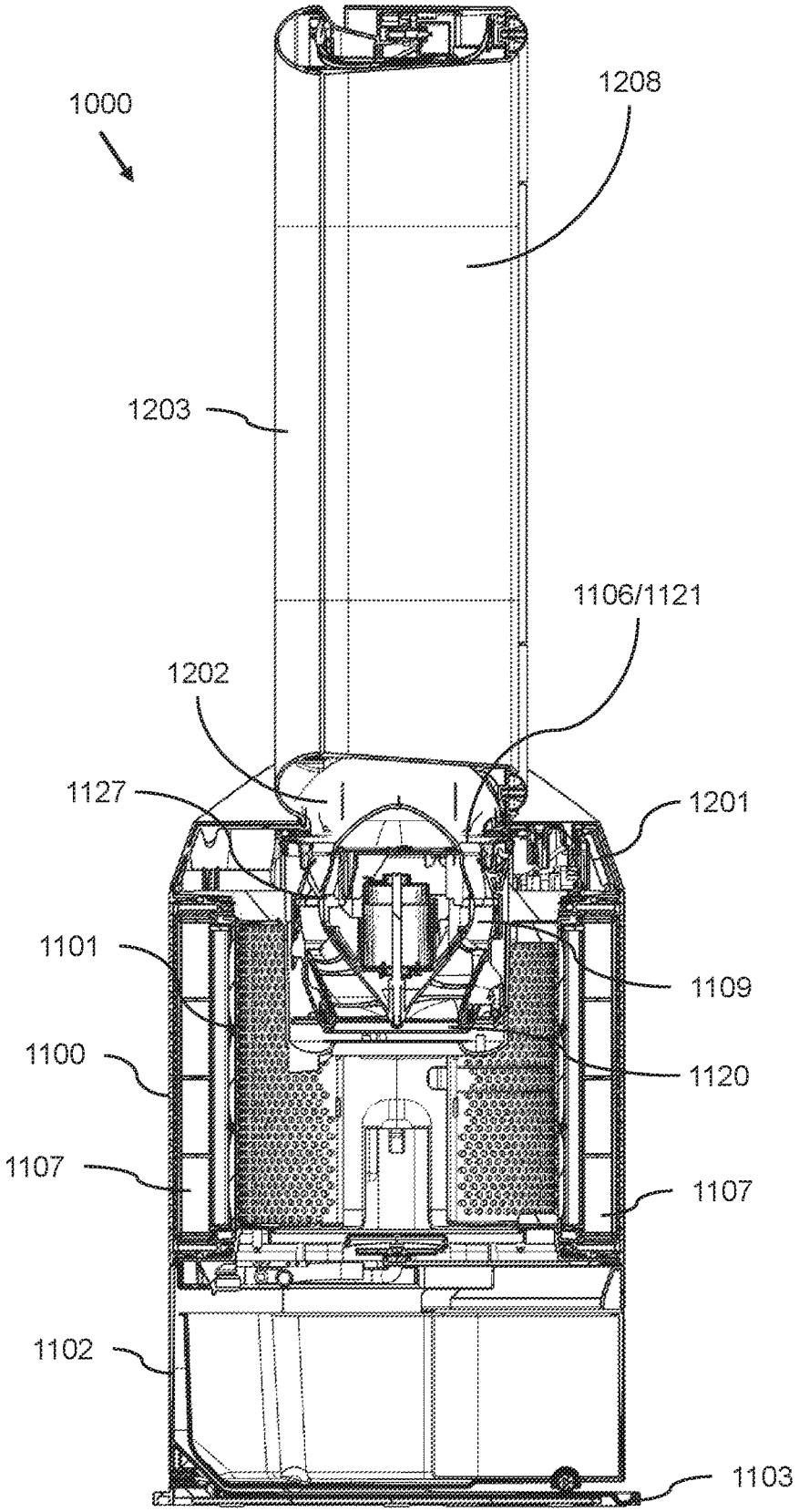
FIG. 4 is a sectional side view through the fan assembly of FIG. 1.
Figure 5:
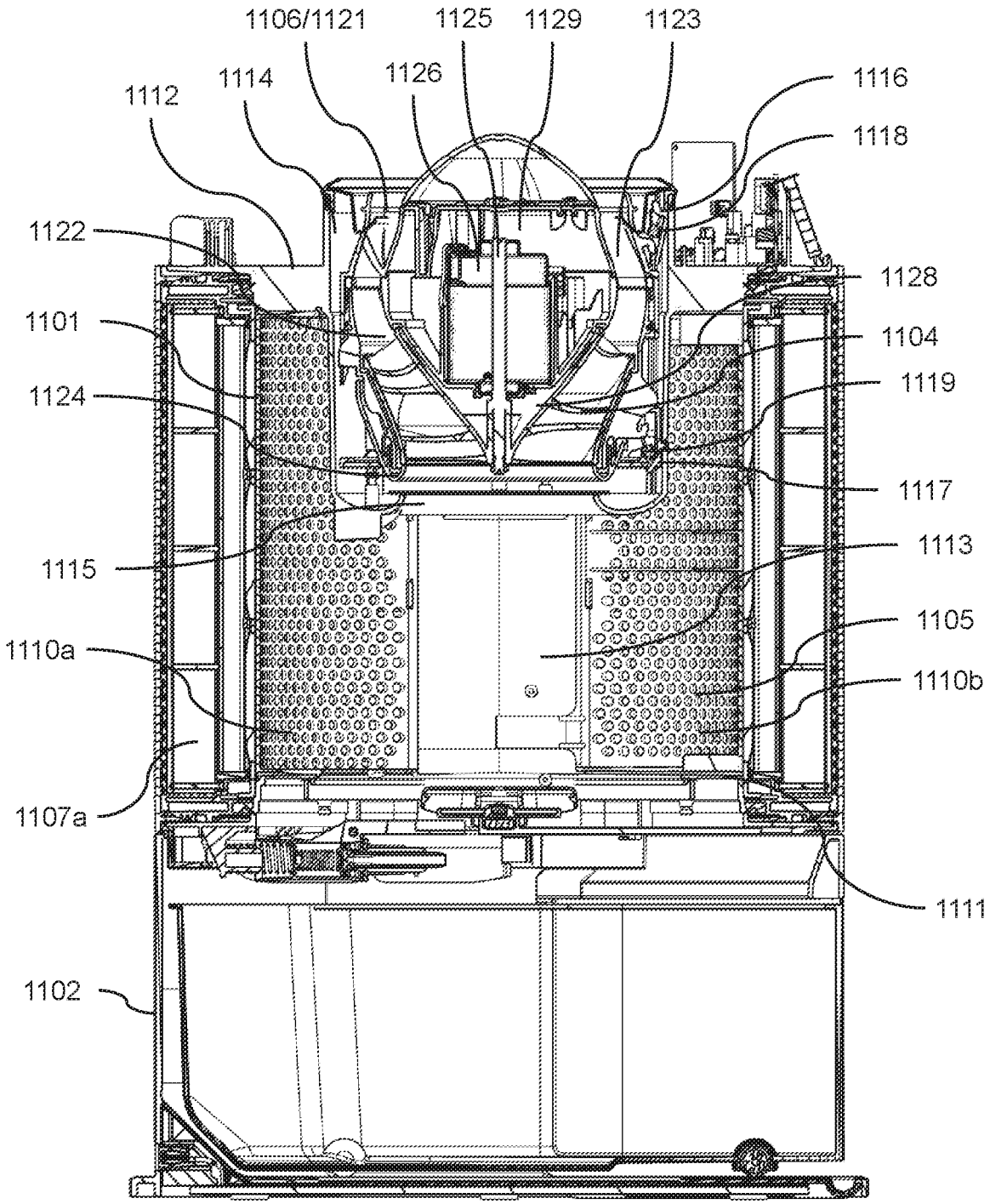
FIG. 5 is a sectional view side through the body of the fan assembly of FIG. 1.
Figure 6:
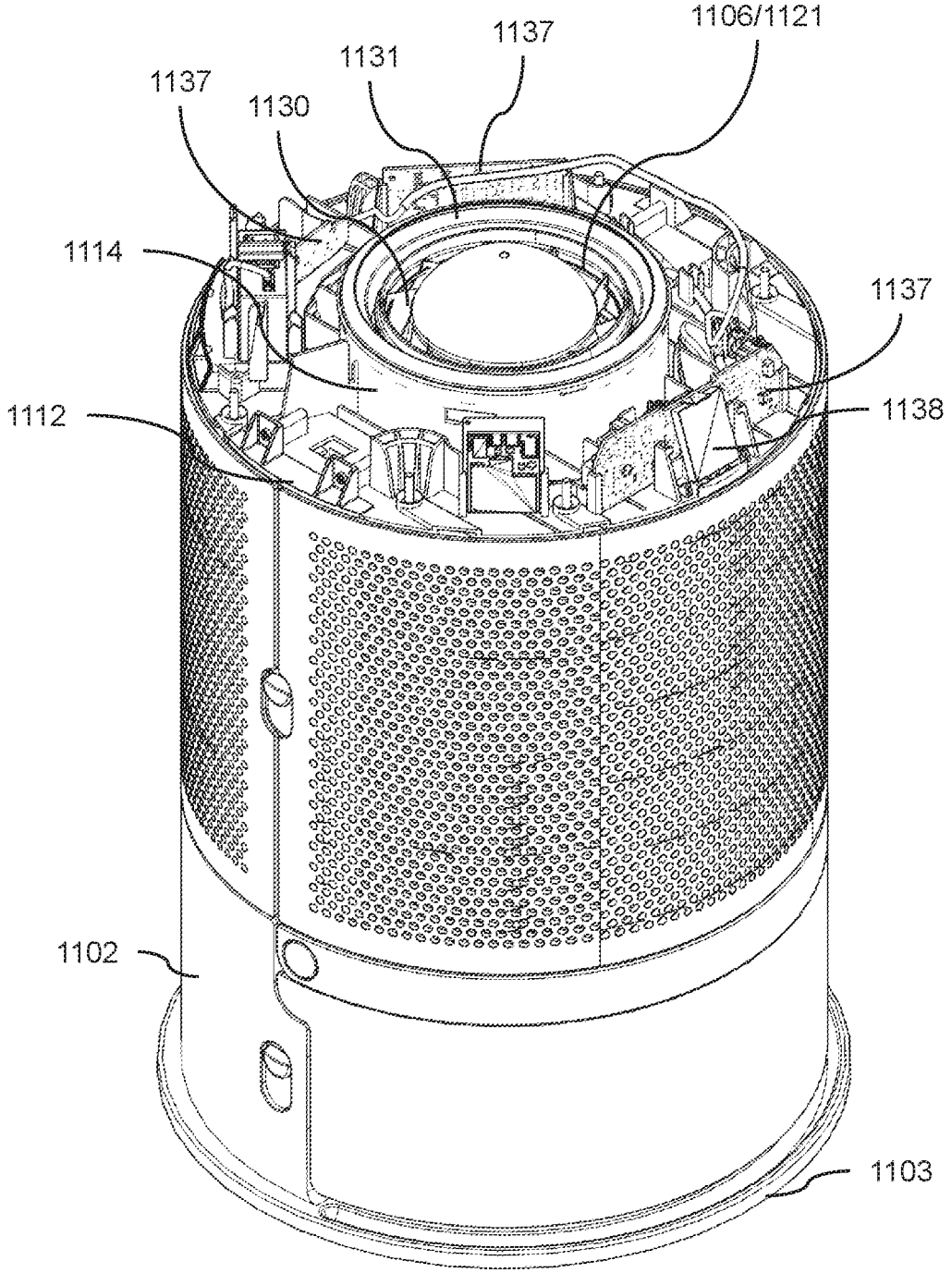
FIG. 6 is an isometric view of the body of the fan assembly of FIG. 1.

FIG. 4 illustrates a sectional side view through the fan assembly 1000 whilst FIG. 5 illustrates a sectional view side through the body 1100 of the fan assembly 1000 without the nozzle 1200 and FIG. 6 shows an isometric view of the body 1100 of fan assembly 1000 without the nozzle 1200.

The body 1100 of the fan assembly 1000 comprises a substantially cylindrical upper body section 1101 mounted on a substantially cylindrical lower body section 1102. The lower body section 1102 provides a base 1103 upon which the fan assembly 1000 rests.

The upper body section 1101 of the fan assembly 1000 contains/houses the motor-driven impeller 1104. The upper body section 1101 is therefore provided with air inlets 1105 through which the motor-driven impeller 1104 can draw a flow of air from outside of the body 1100 of the fan assembly 1000, and an air outlet 1106 through which the air flow generated by the motor-driven impeller 1104 is exhausted from the body 1100 of the fan assembly 1000. The nozzle 1200 is then mounted to an upper end of the upper body section 1101 and is arranged to receive the air flow exhausted from the air outlet 1106 of the body 1100 of the fan assembly 1000.

Figure 7:
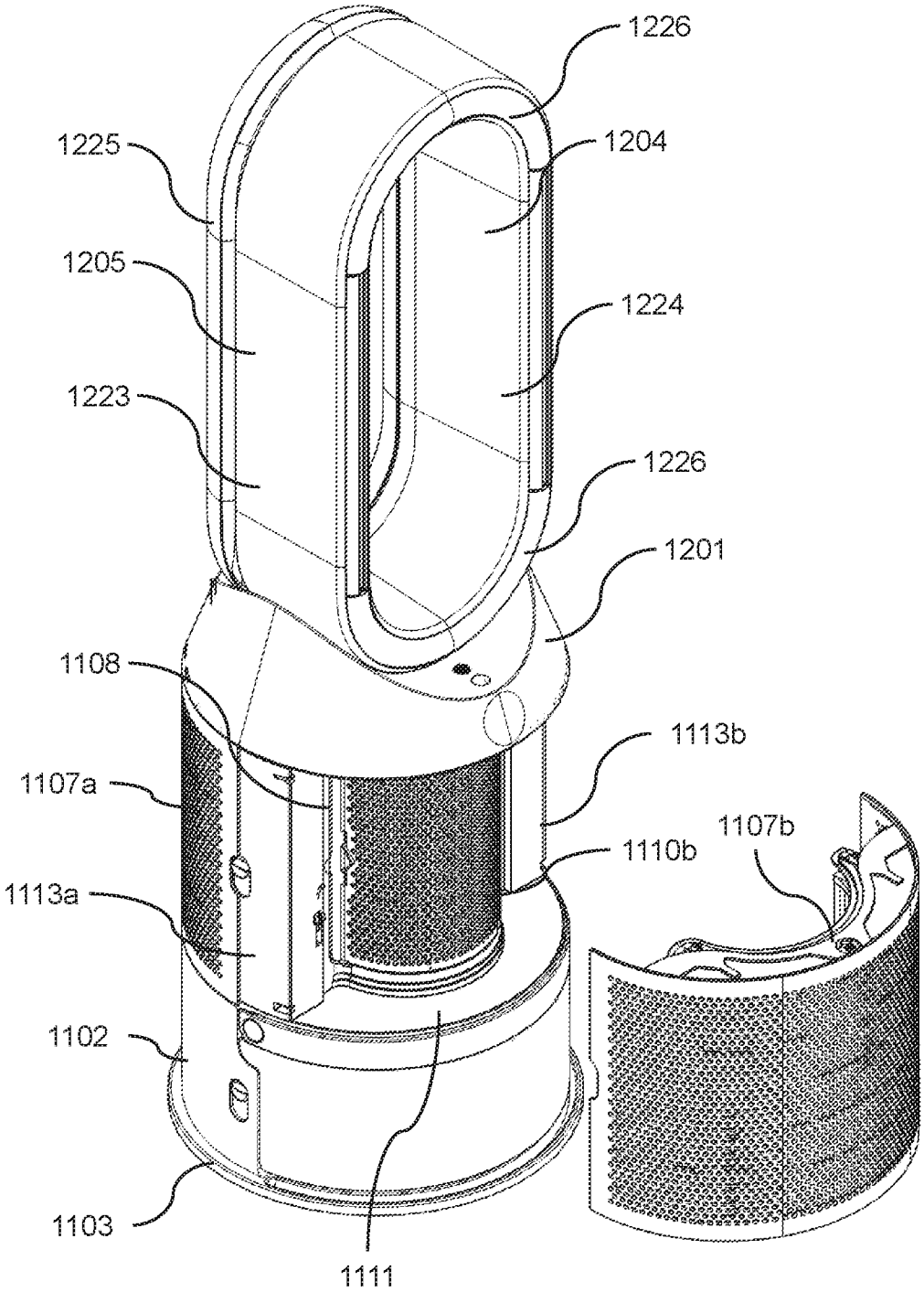
FIG. 7 is an isometric view of fan assembly with one of the filter assemblies detached.

The upper body section 1101 of the fan assembly 1000 is also arranged to support removable filter assemblies 1107 upstream of the air inlets 1105 so that the air flow drawn through the air inlets 1105 by the motor-driven impeller 1104 is filtered prior to entering the body 1100 of the fan assembly 1000. The upper body section 1101 is then also provided with mechanisms for retaining and releasing the filter assemblies 1107 from the body 1100 of the fan assembly 1000. FIG. 7 therefore shows an isometric view of fan assembly 1000 with one of the filter assemblies 1107*b* detached and with the other of the filter assemblies 1107*b* mounted on the far side of the upper body section 1101.

In the illustrated embodiment, the upper body section 1101 of the fan assembly 1000 comprises an upper body chassis 1108. The motor-driven impeller 1104 is then housed within an impeller housing 1109 that is supported towards an upper end of the upper body chassis 1108. The upper body chassis 1108 then defines a cavity below the impeller housing 1109. The upper body section 1101 further comprises a pair of grilles or grates 1110 that are disposed on the upper body chassis 1108 such that they enclose the cavity and the sides of the impeller housing 1109. The grilles 1110 then provide the air inlets 1105 into the upper body section 1101, and the pair of filter assemblies 1107 are releasably retained on the upper body chassis 1108 over the grilles 1110.

In the illustrated embodiment, the upper body chassis 1108 comprises a lower annular flange 1111 located at the lower end of the upper body chassis 1108, an upper annular flange 1112 located towards/adjacent to the upper end of the upper body chassis 1108, and a pair diametrically opposed side sections 1113 that extend vertically between the lower annular flange 1111 and the upper annular flange 1112. Both the lower annular flange 1111 and the upper annular flange 1112 extend radially/perpendicularly away from the longitudinal axis (Z) of the upper body chassis 1108. The outer edge of the lower annular flange 1111 is then substantially flush with the periphery/external surface of the lower body section 1102, whilst the outer edge of the upper annular flange 1112 is substantially flush with the external surface of a base/neck 1201 of the nozzle 1200 that connects to upper end of the upper body chassis 1108.

The upper body chassis 1108 further comprises a fan mount/seat section 1114 provided at the upper end of the upper body chassis 1108 that is arranged to support the impeller housing 1109 within the upper body section 1101. In the illustrated embodiment, the fan mount section 1114 of the upper body chassis 1108 is generally tubular in shape with an inlet bell-mouth 1115 at the lower end and a plain pipe outlet 1106 at the upper end. An upper retention ring 1116 is then located at the upper end of the tubular fan mount section 1114 whilst a lower retention ring 1117 is located towards/adjacent to the lower end of the tubular fan mount section 1114. The impeller housing 1109 is then supported within the tubular fan mount section 1114 by a first set of tension springs 1118 that are connected between the impeller housing 1109 and the upper retention ring 1116 and a second set of tension springs 1119 that are connected between the impeller housing 1109 and the lower retention ring 1117.

In the illustrated embodiment, the impeller housing 1109 extends around the motor-driven impeller 1104 and has a first end defining an air inlet 1120 of the impeller housing 1109 and a second end located opposite to the first end and defining an air outlet 1121 of the impeller housing 1109. The impeller housing 1109 is aligned within the fan mount section 1114 such that the longitudinal axis of the impeller housing 1109 is collinear with the longitudinal axis (Z) of the body 1100 of the fan assembly 1000 and so that the air inlet 1120 of the impeller housing 1109 is located beneath the air outlet 1121. The impeller housing 1109 comprises a generally frusto-conical lower wall 1122 and a generally frusto-conical upper wall 1123. A substantially annular inlet member 1124 is then connected to the bottom of the lower wall 1122 of the impeller housing 1109 for guiding the incoming air flow into the impeller housing 1109. The air inlet 1120 of the impeller housing 1109 is therefore defined by the annular inlet member 1124 provided at the open bottom end of the impeller housing 1109, with this air inlet 1120 of the impeller housing 1109 being disposed above and aligned with the inlet bell-mouth 1115 provided at the lower end of the fan mount section 1114.

In the illustrated embodiment, the impeller 1104 is in the form of a mixed flow impeller and comprises a generally conical hub, a plurality of impeller blades connected to the hub, and a generally frusto-conical shroud connected to the blades so as to surround the hub and the blades. The impeller 1104 is connected to a rotary shaft 1125 extending outwardly from a motor 1126 that is housed within a motor housing 1127 disposed within the impeller housing 1109. In the illustrated embodiment, the motor is a DC brushless motor having a speed which is variable by a control circuit in response to control inputs provided by a user.

The motor housing 1127 comprises a generally frusto-conical lower portion 1128 that supports the motor 1126, and a generally frusto-conical upper portion 1129 that is connected to the lower portion 1128. The shaft 1125 protrudes through an aperture formed in the lower portion 1128 of the motor housing 1127 to allow the impeller 1108 to be connected to the shaft 1125. The upper portion 1129 of the motor housing 1126 further comprises an annular diffuser 1130 in the form of curved blades that project from the outer surface of the upper portion 1129 of the motor housing 1127. The walls of the impeller housing 1109 surround and are spaced from the motor housing 1127 such that the impeller housing 1109 and the motor housing 1127 between them define an annular air flow path which extends through the impeller housing 1109. The air outlet 1121 of the impeller housing 1109, through which the air flow generated by the motor-driven impeller 1104 is exhausted, is then defined by the upper portion 1129 of the motor housing 1127 and the upper wall 1123 of the impeller housing 1109.

A flexible sealing member 1131 is then attached between the impeller housing 1109 and the upper end of the fan mount section 1114 of the upper body chassis 1108. The flexible sealing member 1131 prevents air from passing around the outer surface of the impeller housing 1109. The sealing member 1131 preferably comprises an annular lip seal, preferably formed from rubber.

As mentioned above, the upper body section 1101 of the fan assembly 1000 further comprises a pair of grilles or grates 1110 that are disposed on the opposing open sides of the upper body chassis 1108. Each of the grilles 1110 is provided with an array of apertures which act as the air inlet 1105 of the body 1100 of the fan assembly 1000. Specifically, a first grille 1110*a* is mounted on a first open side of the upper body chassis 1108 whilst a second grille 1110*b* is mounted on a second open side of the upper body chassis 1108. The first grille 1110*a* has the shape of a tubular plate (i.e. has an arcuate cross-section) that is provided with an array of apertures, and is arranged to extend between the upper annular flange 1112 and the lower annular flange 1111 and between the first and second side sections 1113 of the upper body chassis 1108. The second grille 1110*b* then also has the shape of a tubular plate (i.e. has an arcuate cross-section) that is provided with an array of apertures, and is arranged to extend between the upper annular flange 1112 and the lower annular flange 1111 and between the first and second side sections 1113 of the upper body chassis.

Figure 8:
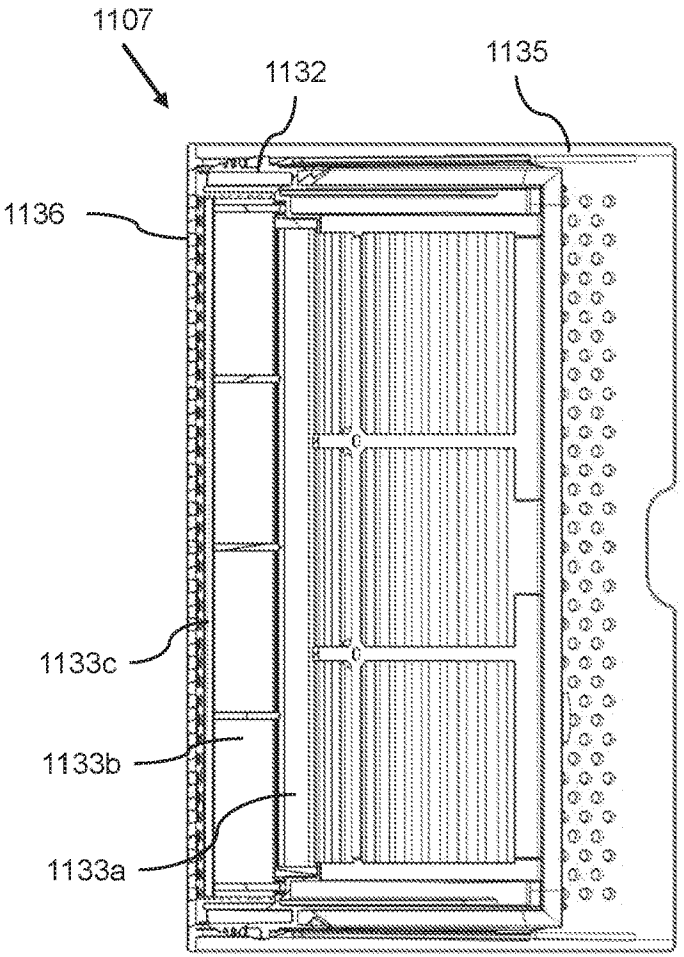
FIG. 8 is a sectional view of a filter assembly suitable for use with the fan assembly of FIG. 1.

In the illustrated embodiment, the side sections 1113 of the upper body chassis 1108 each support one of a pair of filter retention assemblies that cooperate to releasably retain a pair of filter assemblies 1107 on the upper body chassis 1108 over the grilles 1110. Specifically, a first retention assembly is supported within a first side section 1113*a* of the upper body chassis 1108 and a second retention assembly is supported within a second side section 1113*b* of the upper body chassis 1108. The first retention assembly is then configured to releasably engage both a first filter assembly 1107*a* adjacent to a first edge of the first filter assembly 1107*a* and a second filter assembly 1107*b* adjacent to a first edge of the second filter assembly 1107*b*. The second retention assembly is then configured to releasably engage both the first filter assembly 1107*a* adjacent to a second edge of the first filter assembly 1107*a* and the second filter assembly 1107*b* adjacent to a second edge of the second filter assembly 1107*b*. The first edge of the first filter assembly 1107*a* is opposite to the second edge of the first filter assembly 1107*a*, and the first edge of the second filter assembly 1107*b* is opposite to the second edge of the second filter assembly 1107*b*. The filter retention assemblies and the filter assemblies are as described in GB1720055.1 and GB1720057.7, which are hereby incorporated by reference FIG. 8 shows a cross-sectional view of a filter assembly suitable for use with the fan assembly of FIGS. 1 to 7. In the illustrated embodiment, each filter assembly 1107 comprises a filter frame 1132 that supports one or more filter media 1133. Each filter frame 1132 substantially has the shape of a semi-cylinder with two straight sides that are parallel to the longitudinal axis of the filter frame 1132 and two curved ends that are perpendicular to the longitudinal axis of the filter frame 1132. The one or more filter media 1133 are arranged so as to cover the surface area defined by the filter frame 1132. Each filter assembly 1107 further comprises a flexible filter seal 1134 provided around the entirety of an inner periphery of the filter frame 1132 for engaging with the upper body chassis 1108 to prevent air from passing around the edges of the filter assembly 1107 to the grilles 1110 that provide the air inlet 1105 of the body 1100 of the fan assembly 1000. The flexible filter seal 1134 preferably comprises lower and upper curved seal sections that substantially take the form of an arc-shaped wiper or lip seal, with the each end of the lower seal section being connected to a corresponding end of the upper seal section by two straight seal sections that each substantially take the form of a wiper or lip seal. The upper and lower curved seal sections are therefore arranged to contact the those portions of the upper body chassis 1108 that are above and below the grilles 1110, whilst the straight seal sections are arranged to contact one or other of the side sections 1113 of the upper body chassis 1108. Preferably, the filter frame 1132 is provided with a recess (not shown) that extends around the entirety of the inner periphery of the filter frame 1132 and that is arranged to receive and support the flexible filter seal 1134.

The one or more filter media 1133 are then supported on the outer, convex face of the filter frame 1132. In the illustrated embodiment, each filter assembly 1107 comprises a chemical filter media layer 1133*a*, a particulate filter media layer 1133*b* upstream of the chemical filter media layer 1133*a*, and an outer mesh layer 1133*c* upstream of the particulate filter media layer 1133*b*.

Figure 9:
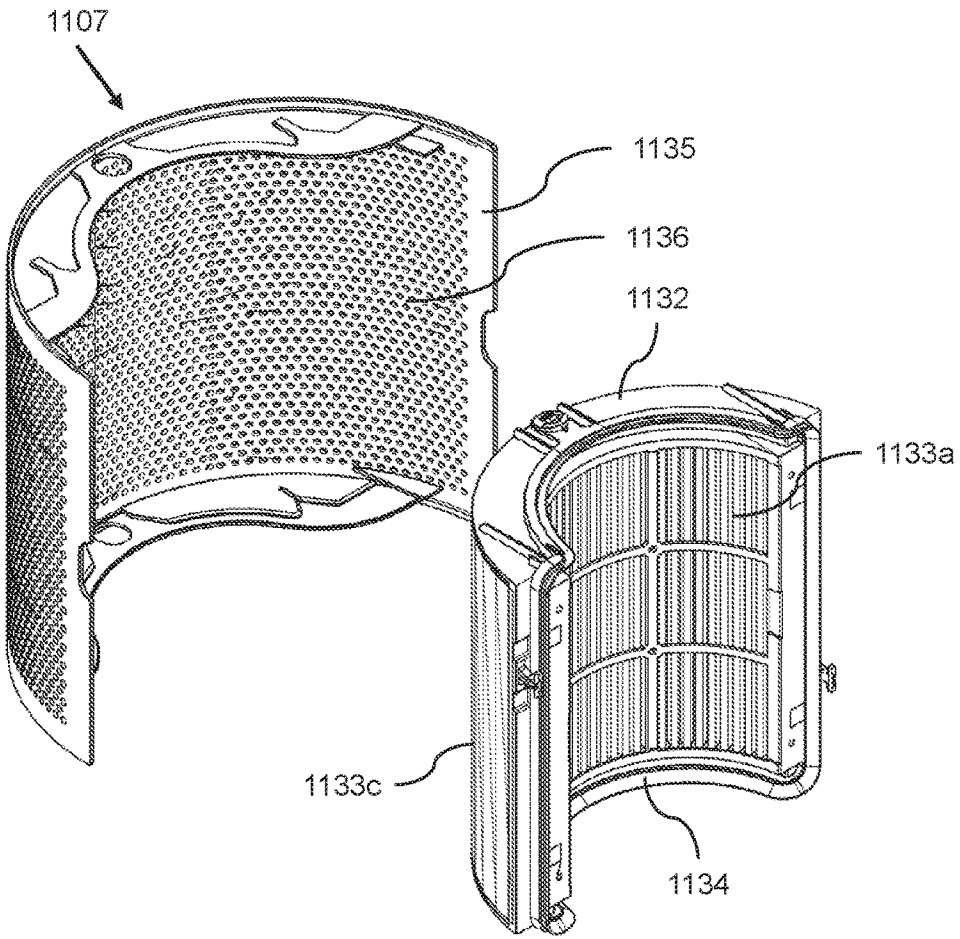
FIG. 9 is a rear perspective view of the filter assembly illustrated in FIG. 8.

A perforated shroud 1135 is then releasably attached to each filter frame 1132 so as to cover the filter assemblies 1107 when located on the body 1100 of the fan assembly 1000. FIG. 9 therefore shows a rear perspective view of the filter assembly illustrated in FIG. 8 with the perforated shroud 1135 detached from the filter frame 1132. Each perforated shroud 1135 comprises an array of apertures which act as an air inlet 1136 of the filter assembly when in use 1107. Alternatively, the air inlet 1136 of the shroud 1135 may comprise one or more grilles or meshes mounted within windows in the shroud 1135. It will also be clear that alternative patterns of air inlet arrays are envisaged within the scope of the present invention. The shroud 1135 protects the filter media 1133 from damage, for example during transit, and also provides a visually appealing outer surface for the filter assemblies 1107, which is in keeping with the overall appearance of the fan assembly 1000. As the shroud 1135 defines the air inlet 1136 for the filter assembly 1107, the array of apertures are sized to prevent larger particles from entering the filter assembly 1107 and blocking, or otherwise damaging, the filter media 1133. In the illustrated embodiment, the perforated shroud 1135 is substantially in the shape of a semi-cylinder and is arranged to cover the area that extends between the outer edge of the upper annular flange 1112 and the outer edge of the lower annular flange 1111 and between the outer surfaces of the first and second side sections 1113 of the upper body chassis 1108.

When in use rotation of the impeller 1104 by the motor 1126 generates an air flow through the impeller housing 1109. This air flow draws air into the body 1100 of the fan assembly 1000 through the filter assemblies 1107 that are mounted over the air inlets 1105. The air flow then passes through the impeller housing 1109 and exits the body 1100 of the fan assembly 1000 through an air vent/opening provided at the upper end of the upper body section 1101, which is provided by air outlet 1121 of the impeller housing 1109, and into the nozzle 1200.

The nozzle 1200 is mounted on the upper end of the body 1100 over the air vent 1121 through which the air flow exits the body 1100. The nozzle 1200 comprises a neck/base 1201 that connects to the upper end of the body 1100 and has an open lower end which provides an air inlet 1202 for receiving the air flow from the body 1100. The external surface of the base 1201 of the nozzle 1200 is then substantially flush with the outer edge of the upper annular flange 1112 of the upper body chassis 1108. The base 1201 therefore provides a housing that covers/encloses any components of the fan assembly 1000 that are provided on the upper surface of the body 1100, which in this embodiment is provided by the upper surface of the upper annular flange 1112.

In the illustrated embodiment, a number of control circuits 1137 are mounted on the upper surface of the upper annular flange 1112 that extends radially away from the upper end of the upper body section 1101. These control circuits 1137 are therefore housed within base 1201 of the nozzle 1200. In addition, an electronic display 1138 is also mounted on the upper annular flange 1112 of the upper body section 1101 and therefore housed within base 1201 of the nozzle 1200, with the display 1138 being visible through an opening or at least partially transparent window provided in the base 1201 of the nozzle 1200. Optionally, one or more additional electronic components may be mounted on the upper surface of the upper annular flange and consequentially housed within base 1201 of the nozzle 1200. For example, these additional electronic components may one or more wireless communication modules, such as Wi-Fi, Bluetooth etc., and one or more sensors, such as a humidity sensor, an infrared sensor, a dust sensor etc., and any associated electronics. Any such additional electronic components would then also be connected to one or more of the control circuits.

In the illustrated embodiment, the nozzle 1200 then further comprises a nozzle body 1203 that has an elongate annular shape, often referred to as a stadium or discorectangle shape, and defines a correspondingly shaped bore 1204 having a height (as measured in a direction extending from the upper end of the nozzle 1200 to the lower end of the nozzle 1200) greater than its width (as measured in a direction extending between the side walls of the nozzle 1200), and a central axis (X). The nozzle body 1203 therefore comprises two parallel, straight side sections 1205 each adjacent a respective elongate side of the bore 1204, an upper curved section 1206 joining the upper ends of the straight sections 1205, and a lower curved section 1207 joining the lower ends of the straight sections 1205.

Figure 10:
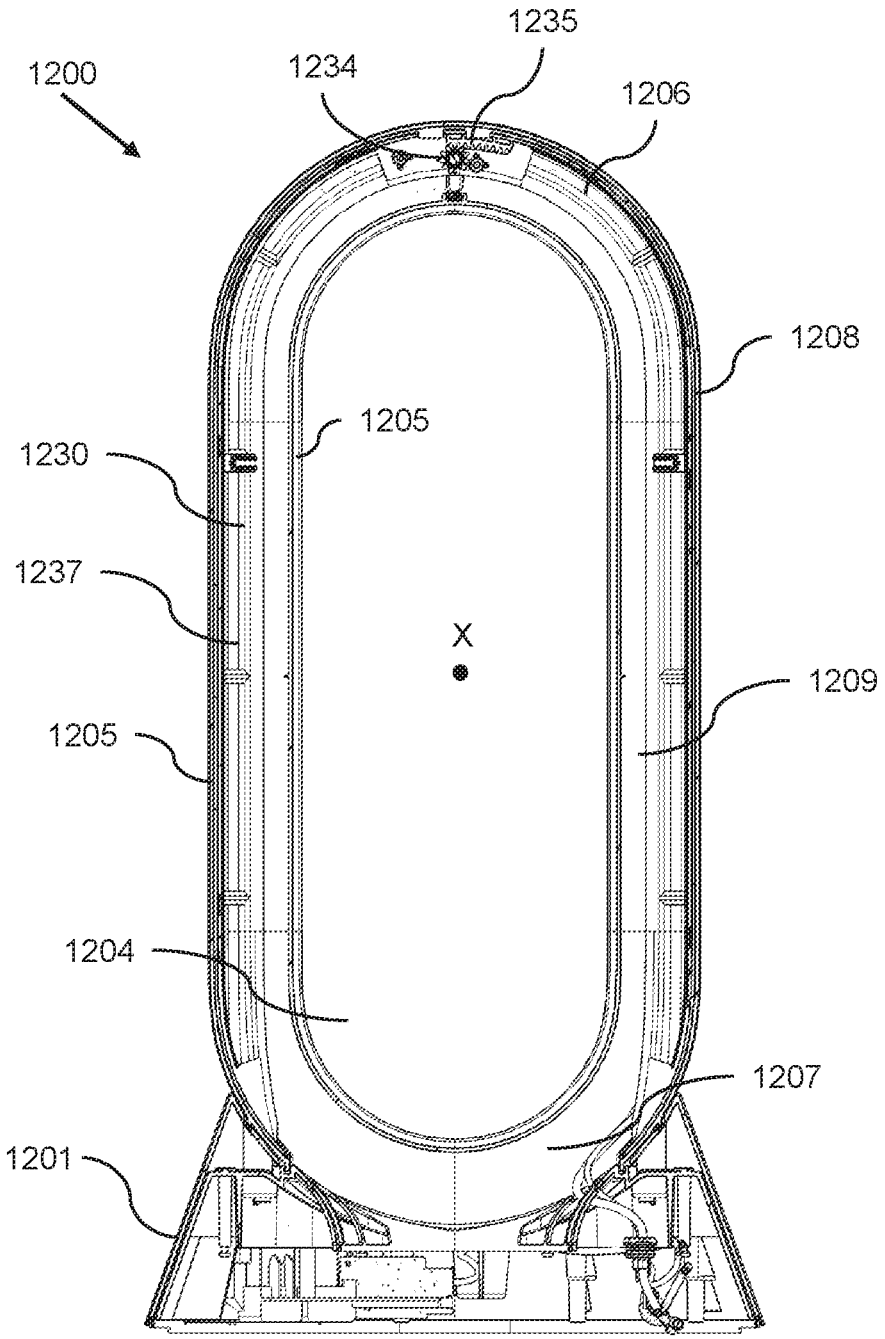
FIG. 10 is a front sectional view of an embodiment of a nozzle suitable for use with the fan assembly described herein.

FIG. 10 shows a front cross-sectional view of a specific embodiment of the nozzle 1200. In the illustrated embodiment, the nozzle body 1203 comprises an elongate annular casing 1208 that extends around the central bore 1204 of the nozzle 1200. The nozzle casing 1208 defines an interior passage 1209 that is arranged to convey air from the air inlet 1202 of the nozzle 1200 to one or more air outlets 1210, 1211. The interior passage 1209 defined by the casing 1208 may be considered to comprise first and second sections which each extend in opposite directions about the inner bore 1204, as the air that enters the nozzle 1200 through the air inlet 1202 will enter the lower curved section 1207 of the nozzle body 1203 and be divided into two air streams which each flow into a respective one of the straight sections 1205 of the nozzle body 1203.

Each one of the parallel side sections 1205 of the nozzle body 1203 then forms a separate elongate, outlet section 1212 of the nozzle, with these outlet sections 1212 extending substantially along the whole length of the side sections 1205. Each outlet section 1212 then comprises a steerable/maneuverable air outlet 1210 that is arranged to emit a portion of the air flow from the nozzle 1200, with each of the steerable air outlets 1210 being arranged to be independently rotated relative to the nozzle casing 1208. The nozzle 1200 therefore provides that the direction of the portion of the air flow emitted by each of the steerable air outlets 1210 can be varied without rotating the nozzle 1200 relative to any portion of the body 1100.

Figure 11:
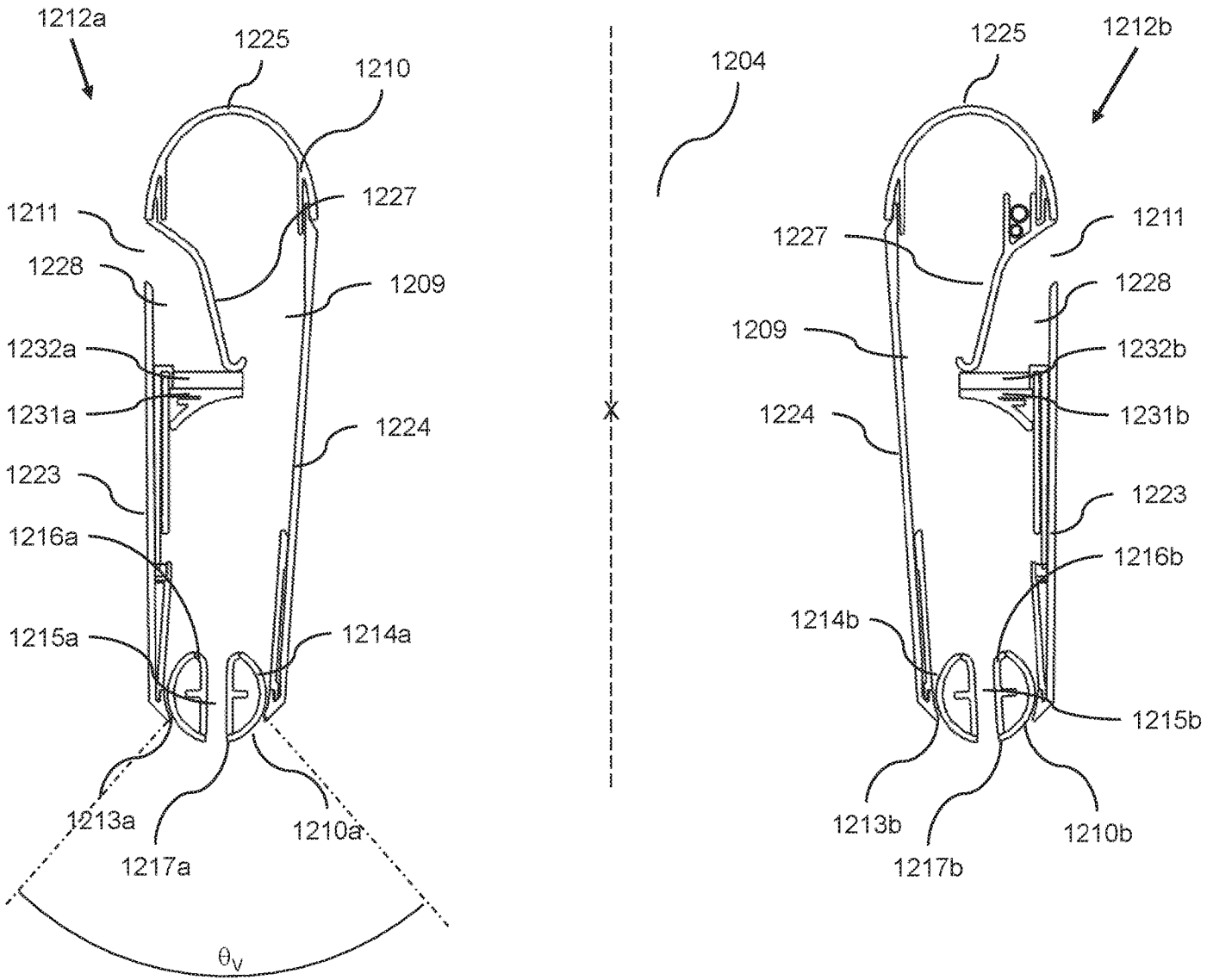
FIG. 11 is a top sectional view through the nozzle of FIG. 10.

FIG. 11 is a top cross-sectional view through the nozzle 1200 of FIG. 10. In the illustrated embodiment, each of the steerable air outlets 1210 comprises an elongate, forward-facing opening 1213 defined by the corresponding outlet section 1212 of the nozzle body 1203 and a generally cylindrical, elongate exhaust/outlet body 1214 that is disposed within the opening 1213 and that is arranged to rotate within the opening 1213 around a longitudinal axis (B) of the outlet body 1214. Each outlet body 1214 is then provided with an air outlet slot or channel 1215 that extends through the width of the outlet body 1214 and that therefore allows air to flow out of the nozzle 1200 through the outlet body 1214. Rotating the outlet body 1214 within the opening 1213 therefore changes the orientation of the air outlet channel 1215 relative to the nozzle body 1203 such that the air flow emitted through the outlet body 1214 also changes direction. The nozzle 1200 therefore comprises two elongate, steerable air outlets 1210 that are each located on a respective elongate side of the central bore 1204 at the front of the nozzle 1200.

In the illustrated embodiment, the two steerable air outlets 1210 each comprise an outlet body 1214 that is generally cylindrical, and therefore has a circular cross-section, and in which the air outlet channel 1215 is straight and extends diametrically through the outlet body 1214. The steerable air outlets 1210 are arranged such that a portion of the curved outer surface of the outlet body 1214 projects outwardly through the corresponding opening 1213, with an ingress end 1216 of the air outlet channel 1215 being provided on the portion of the outlet body 1214 that is disposed within the interior of the corresponding outlet section 1212 and an egress end 1217 of the air outlet channel 1215 being disposed on the portion of the outlet body 1214 that is exposed through the opening 1213 of the corresponding outlet section 1212. The ingress end 1216 of the air outlet channel 1215 is then provided with a bell-mouth to assist with channeling air flowing within the interior passage 1209 of the nozzle 1200 into the air outlet channel 1215.

Figure 12A:
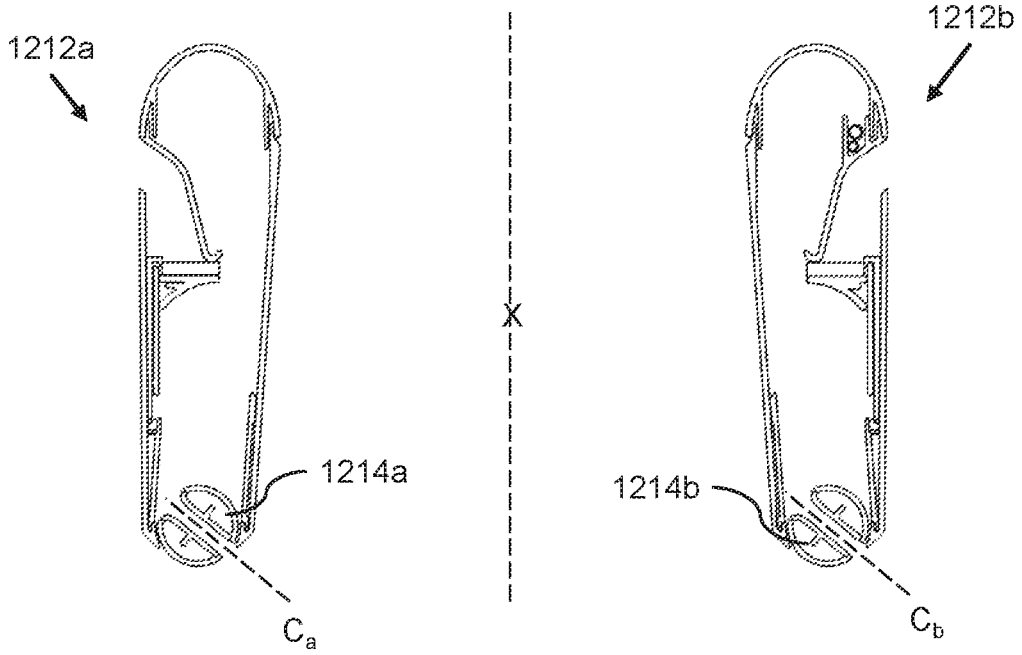
FIG. 12*a* is a top sectional view through the nozzle of FIG. 10 in a first configuration.
Figure 12B:
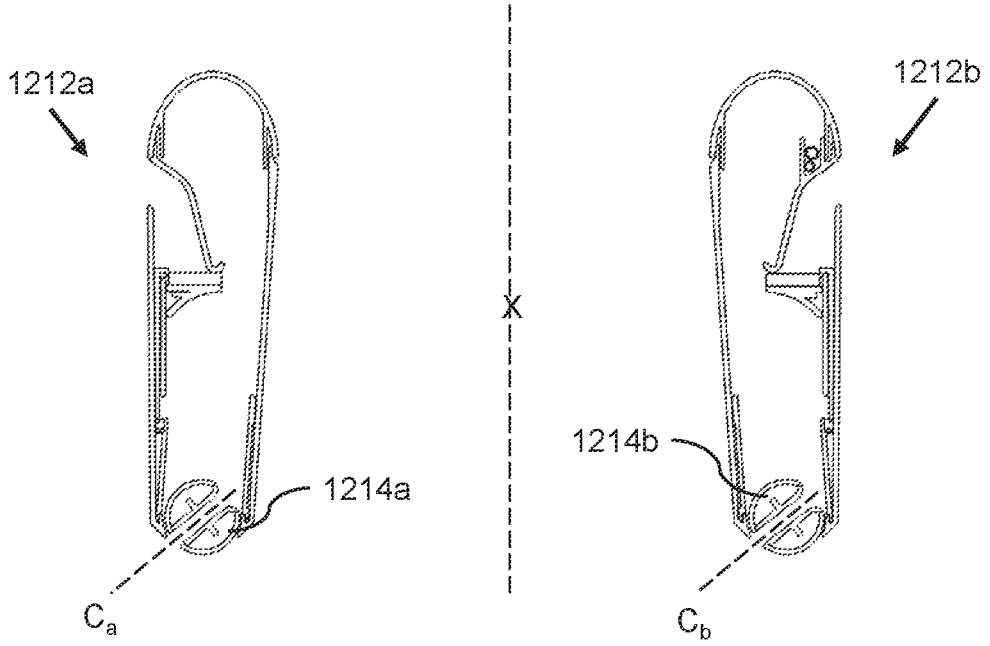
FIG. 12*b* is a top sectional view through the nozzle of FIG. 10 in a second configuration.

In the illustrated embodiment, each of the steerable air outlets 1210 is arranged to have a vectoring range (θV) of approximately 100 degrees, wherein the vectoring range is the angular range over which the air flow emitted from the nozzle 1200 through the corresponding outlet body 1214 can be varied. By way of example, FIG. 12*a* shows the steerable air outlets 1210 at a first end of their vectoring range, whilst FIG. 12*b* shows the steerable air outlets 1210 at an opposite second end of their vectoring range.

In the illustrated embodiment, a vectoring range of approximately 100 degrees requires from 18% to 20% of the outlet body 1214 to project outwardly through the corresponding opening 1213. However, each of the steerable air outlets 1210 could equally be arranged to have a vectoring range of anything from 45 to 180 degrees, which would then require anything from 4% to 50% of the outlet body 1215 to project outwardly through the corresponding opening 1213. It is then preferable that the centre/mid-point of the vectoring range of each outlet body 1214 is aligned with a plane that longitudinally bisects the corresponding opening 1213, which in the illustrated embodiment will also be parallel to a plane that longitudinally bisects the nozzle body 1203.

Figure 13:
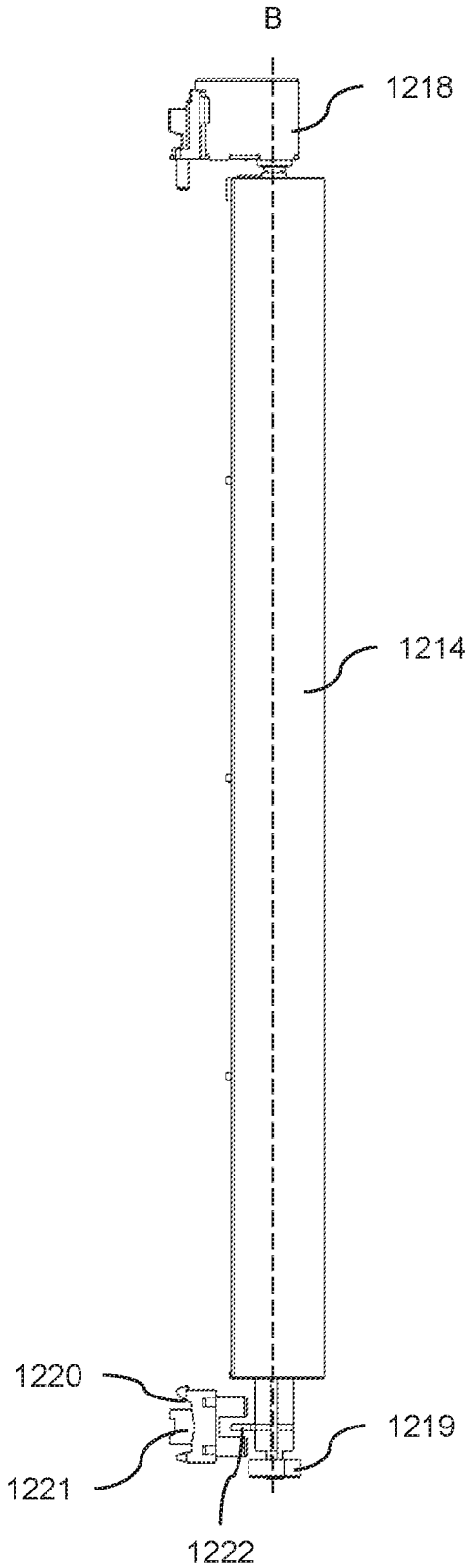
FIG. 13 is a side view of an embodiment of a steerable air outlet suitable for use with the nozzle described herein.
Figure 14:
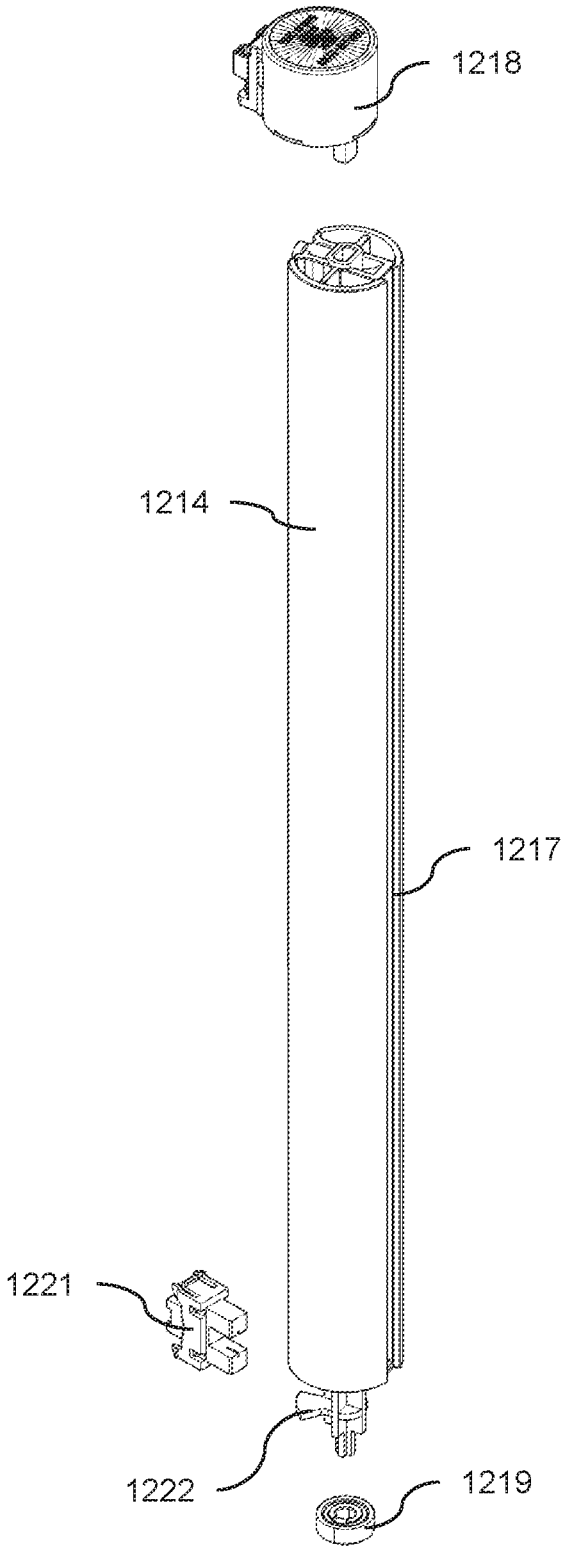
FIG. 14 is an exploded view of the steerable air outlet of FIG. 13.

FIG. 13 shows a side view of a specific embodiment of a steerable air outlet 1210, whilst FIG. 14 shows an exploded view of the steerable air outlet 1210 of FIG. 13. In the illustrated embodiment, one end of the elongate outlet body 1214 is then attached to the shaft of a steering motor 1218 such that operation of the steering motor 1218 will cause the outlet body 1214 to rotate within the elongate opening 1213 defined by the nozzle casing 1208. The opposite end of the outlet body 1214 is then disposed within a bearing 1219. The direction of the air flow emitted from the each of the steerable air outlets 1210 can therefore be varied by controlling the corresponding steering motor 1218 to adjust the angular orientation of the air outlet channel 1215. One or more of the control circuits 1137 are therefore arranged to independently control the steering motors 1218 of each of the steerable air outlets 1210.

Figure 15A:
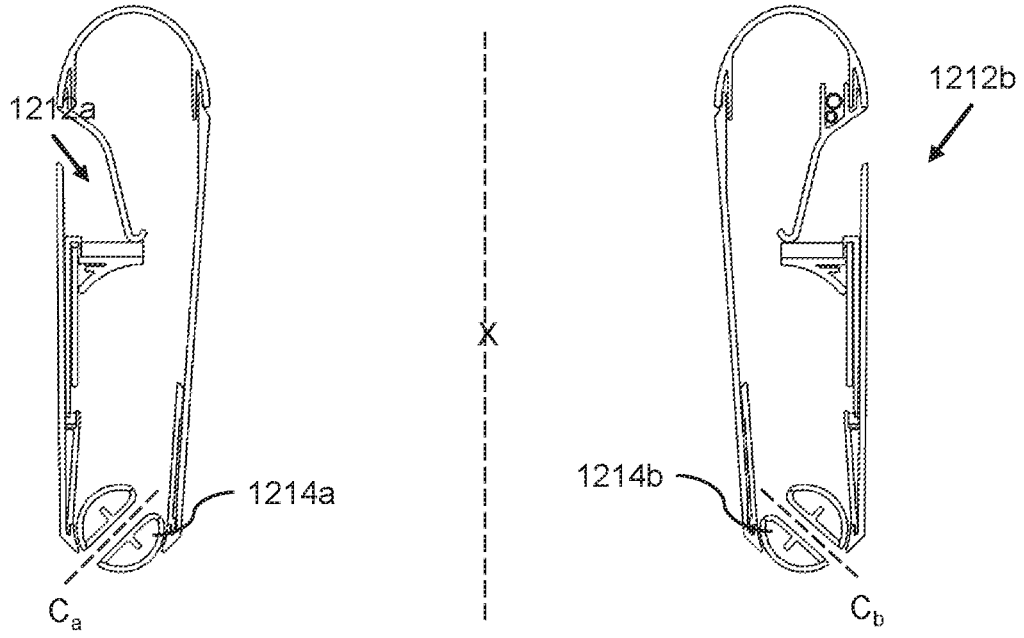
FIG. 15*a* is a top sectional view through the nozzle of FIG. 10 in a third configuration.

The steerable air outlets 1210 can be operated in any of a diffused mode and a focussed mode. When in the diffused mode, the two (left and right) steerable air outlets 1210 are oriented such that their central axes do not converge. For example, in diffused mode the outlet bodies 1214 of the steerable air outlets 1210 could be oriented so that the central axis (Ca, Cb) of their air outlet channels 1215 are parallel. Alternatively, in diffused mode the outlet bodies 1214 of the steerable air outlets 1210 could be oriented so that the central axis (Ca, Cb) of their air outlet channels 1215 diverge away from another. By way of example, FIG. 15*a* shows a top cross-sectional view through the nozzle 1200 of FIG. 10 in which the outlet bodies 1214 are configured to operate in a diffused mode. The relative orientations of the two steerable air outlets 1210 could then be maintained during any change in overall direction of the air flow emitted from the nozzle 1200 and/or during any oscillation of the air flow emitted from the nozzle 1200 by ensuring that the rotational speed of the two (left and right) steering motors 1218 is equal.

Figure 15B:
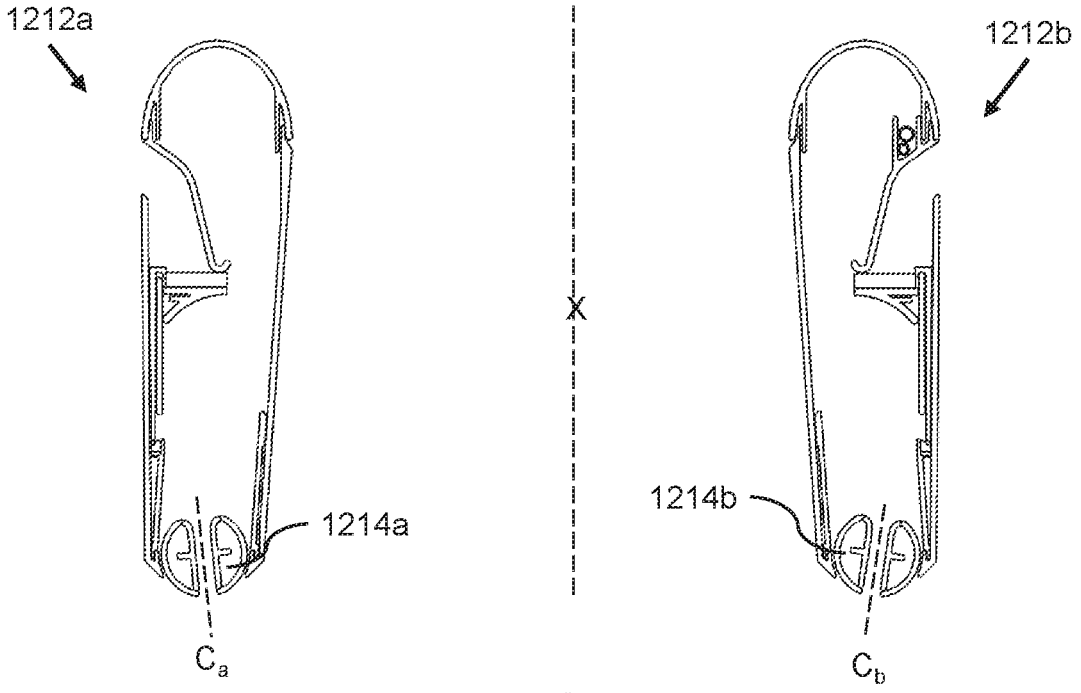
FIG. 15*b* is a top sectional view through the nozzle of FIG. 10 in a fourth configuration.

When in the focussed mode, the two (left and right) steerable air outlets 1210 are aimed in convergent directions. In other words, the two steerable air outlets 1210 are oriented so that their central axes (Ca, Cb) intersect. In particular, in focussed mode the outlet bodies 1214 of the steerable air outlets 1210 could be oriented so that the central axis (Ca, Cb) of their air outlet channels 1215 converge. By way of example, FIG. 15*b* shows a top cross-sectional view through the nozzle 1200 of FIG. 10 in which the outlet bodies 1214 are configured to operate in a focussed mode. In focussed mode, the nozzle 1200 can be further arranged so that the distance from the front face of the nozzle body 1203 at which the central axes (Ca, Cb) of the two steerable air outlets 1210 converge is constant irrespective of their orientation. Maintaining this constant distance during any change in overall direction of the air flow emitted from the nozzle 1200 and/or during any oscillation of the air flow emitted from the nozzle 1200 would then require that the two (left and right) steering motors 1218 are operated at different rotational speeds. To do so, the control circuits 1137 are arranged to simultaneously oscillate a first of the steerable air outlets 1210*a* at a first speed and a second of the steerable air outlets 1210*b* at a second speed that is different to the first speed. For example, the control circuits 1137 could be configured such that when a first of the steerable air outlets 1210*a* is rotating away from the second of the steerable air outlets 1210*b* the first speed is less than the second speed, and when the first of the steerable air outlets 1210*a* is rotating towards the second of the steerable air outlets 1210*b* the first speed is greater than the second speed.

In the illustrated embodiment, each of the steerable air outlets 1210 further comprises an outlet body orientation detection mechanism/system 1220 that is arranged to detect the orientation of the outlet body 1214 relative to the nozzle body 1203. In particular, the outlet body orientation detection mechanism 1220 is arranged to detect which one of two portions of an available range of rotation the outlet body 1214 is currently in. The outlet body orientation detection mechanism 1220 comprises a photo-interrupter 1221 provided on the nozzle body 1203, within the corresponding outlet section 1212, and a screen 1222 that is arranged to be detected by the photo-interrupter 1221 when the outlet body 1214 is in one of the two portions of the range of rotation. In this regard, a photo-interrupter is photo-sensor that comprises light emitting elements and light receiving elements that are aligned facing each other across a gap defined between them. The photo-interrupter then works by detecting when a target object comes between both elements and prevents light from the emitting elements from reaching the receiving elements. Typically, an infrared emitter is used as the light emitting element while an infrared detector is employed as the receiving element. In the illustrated embodiment, the photo-interrupter 1221 is disposed such that the gap between the light emitting elements and the light receiving elements is approximately aligned with the axis of rotation of the outlet body 1214 and the centre of the corresponding opening 1213. The screen 1222 then projects radially from the axis of rotation of the outlet body 1214 (i.e. the longitudinal/central axis) and extends over one of the two portions of the range of rotation. The screen 1222 therefore has two edges that extend radially away from the rotational axis and can therefore have either a triangular or circular sector shape.

The photo-interrupter 1221 of each of the steerable air outlets 1210 is arranged to provide its output as an input to the control circuits 1137. The control circuits 1137 are then configured to use the input from the photo-interrupter 1221 to control the steering motors 1218 of each of the steerable air outlets 1210. In particular, initially the input received from the photo-interrupter 1221 of each of the steerable air outlets 1210 will indicate either that the gap is blocked and that the corresponding outlet body 1214 is therefore in the first of the two portions of the range of rotation, or that the gap is clear and that the corresponding outlet body 1214 is therefore in the second of the two portions of the range of rotation. The control circuits 1137 are then configured to operate each steering motor 1218 such that each of the outlet bodies 1214 are rotated towards a distal end of the range of rotation. During this rotation of each of the outlet bodies 1214, an edge of the corresponding screen 1222 will pass through the gap such that the photo-interrupter 1221 will transition between being blocked and being clear, and the control circuits 1137 will thereby determine the exact position of the outlet body 1214 within the range of rotation.

In the illustrated embodiment, the orientation detection mechanisms 1220 of each of the steerable air outlets 1210 are arranged such that a first edge of the screen 1222 is detected/aligned with the photo-interrupter 1221 when the corresponding outlet body 1214 is orientated at a first end of the vectoring range, which does not coincide with the available range of rotation. The orientation detection mechanisms 1220 of each of the steerable air outlets 1210 are then further arranged such that a second edge of the screen 1222 is detected/aligned with the photo-interrupter 1221 when the centre axis of the air outlet channel 1215 of the corresponding outlet body 1214 is approximately 7 degrees away from a mid-point of the vectoring range (i.e. from a plane that longitudinally bisects the corresponding opening 1214) with the centre axis of the air outlet channel 1215 orientated towards a plane that longitudinally bisects the nozzle body 1203. However, the orientation detection mechanisms 1220 may equally be arranged such that the second edge of the screen 1222 is detected/aligned with the photo-interrupter 1221 when the centre axis of the air outlet channel 1215 of the corresponding outlet body 1214 is between 0 and 40 degrees away from a mid-point of the vectoring range. Configuring the orientation detection mechanism 1220 of each of the steerable air outlets 1210 in this way provides that the control circuits 1137 can detect when the outlet bodies 1214 of both steerable air outlets 1210 are oriented in convergent directions, such that their central axes intersect on a plane that longitudinally bisects the nozzle body 1203.

In the illustrated embodiment, the elongate annular casing 1208 comprises an elongate annular outer casing section 1223 that is concentric with and extends about an elongate annular inner casing section 1224. In this example, the inner casing section 1223 and the outer casing section 1224 are integrally formed as a single piece; however, they could also be formed as separate components. The annular casing 1208 further comprises a curved rear casing section 1225 that forms the rear of the nozzle body 1203, with an inner end of the curved rear casing section 1225 being connected to a rear end of the inner casing section 1224. In this example, the inner casing section 1224 and the curved rear casing section 1225 are separate components that are connected together, for example, using screws and/or adhesives; however, they could also be integrally formed as a single piece. The curved rear casing section 1225 has a generally elongate annular cross-section perpendicular to the central axis of the inner bore 1204 of the nozzle 1200, and a generally semi-circular cross-section parallel to the central axis of the inner bore 1204 of the nozzle 1200.

The inner casing section 1224 has a generally elongate annular cross-section perpendicular to the central axis of the inner bore 1204 of the nozzle 1200, and extends around and surrounds the inner bore 1204 of the nozzle 1200. In this example, the inner casing section 1224 is angled outwardly from the rear end of the inner casing section 1224 away from the central axis (X) of the inner bore 1204. The inner casing section 1224 therefore tapers towards the front end of the outer casing section 1223, but does not meet the front end of the outer casing section 1223, such that there is a gap/space between the front end of the inner casing section 1224 and the front end of the outer casing section 1223. The casing 1208 then further comprises two curved covers 1226 at the top and bottom curved sections 1206, 1207 of the nozzle body 1203 that extend across the gap between the front end of the inner casing section 1224 and the front end of the outer casing section 1223. Those portions of the gap that then extend along the straight side sections 1205 then each define the elongate, forward facing openings 1213 of the two steerable air outlets 1210, with an outlet body 1214 then being disposed within each of the elongate openings 1213. The nozzle 1200 therefore comprises two first air outlets 1210 that are each located on a respective elongate side 1205 of the central bore 1204 at the front of the nozzle 1200, with these first air outlets 1210 being steerable air outlets.

The outer casing section 1223 then extends from the front of the nozzle body 1203 towards an outer end of the curved rear casing section 1225, but does not meet the outer end of the curved rear casing section 1225, such that there is a gap/space between a rear end of the outer casing section 1223 and the outer end of the curved rear casing section 1225. This gap between the rear end of the outer casing section 1223 and the outer end of the curved rear casing section 1225 therefore provides a second air outlet 1211, which is separate to the steerable first air outlets 1210, with this second air outlet 1211 extending around a portion of the outermost surface of the nozzle body 1203 (i.e. the external surface of the nozzle 1200 that faces in a direction that is substantially perpendicular to the central axis of the bore 1204).

The outer casing section 1223, inner casing section 1224 and curved rear casing section 1225 therefore define the interior passage 1209 for conveying air from the air inlet 1202 of the nozzle 1200 to one or both of the first air outlets 1210 and the second air outlet 1211. In other words, the interior passage 1209 is bounded by the internal surfaces of the outer casing section 1223, inner casing section 1224 and curved rear casing section 1225. The interior passage 1209 may be considered to comprise first and second sections which each extend in opposite directions about the bore 1204, as the air that enters the nozzle 1200 through the air inlet 1202 will enter the lower curved section 1207 of the nozzle body 1203 and be divided into two air streams which each flow into a respective one of the straight sections 1205 of the nozzle body 1203.

The casing 1208 of the nozzle body 1203 then further comprises a baffle 1227 that is provided within the interior passage 1209 that is arranged to direct an air flow within the interior passage 1209 towards the second air outlet 1211. The baffle 1227 extends into the interior passage 1209 from an interior surface of the nozzle body 1203 that at least partially defines the interior passage 1209. The section of the interior passage 1209 that is bounded by both the baffle 1227 and a portion of the interior surface of the nozzle body 1203 that is adjacent to the second air outlet 1211 therefore defines an air outlet channel 1228 of the second air outlet 1211 through which air within the nozzle body 1203 is directed to the second air outlet 1211.

The baffle 1227 is provided by a baffle wall that extends into the interior passage 1209 from the curved rear casing section 1225. The baffle wall 1227 is connected to the outer end of the curved rear casing section 1225 and has a front portion 1227*a* and a rear portion 1227*b*. The baffle wall 1227 is angled inwardly from the outer end of the curved rear casing section 1225 towards the central axis (X) of the bore 1204 and extends towards the front of the nozzle body 1203 so that at least a portion of the baffle wall 1227 overlaps with an adjacent portion of the outer casing section 1223. An ingress end of the air outlet channel 1228 of the second air outlet 1211, as defined by front end of the baffle wall 1227 and the inner surface of the outer casing section 1223, is substantially perpendicular to the central axis (X) of the bore 1204 defined by the nozzle body 1203.

The baffle wall 1227 extends up the elongate sides of the interior passage 1209 and around the upper curved section 1206. The elongate sides of the baffle wall 1227 are generally straight; whilst the lower ends of the baffle wall extend only partially into the lower curved section 1207 until they meet the interior surface of the lower curved section 1207 of the interior passage 1209 so that the air flow entering the nozzle body 1203 cannot enter the air outlet channel 1228 of the second air outlet 1211 via this lower end. In addition, the baffle wall 1227 further comprises a projection at the peak/centre of upper curved section 1206 that extends from the outward facing surface of the baffle wall 1227 to the inner surface of the outer casing section 1223 thereby separating the adjacent portion of the air outlet channel 1228 of the second air outlet 1211 from the interior passage 1209 and splitting the opening from the interior passage 1209 into the air outlet channel 1228 of the second air outlet 1211 into two sections, with each section of the opening extending up one of the elongate sides 1205 and partially around the upper curved section 1206 of the interior passage 1209 until they reach the projection at the peak of the upper curved section 1206.

The fan assembly 1000 then comprises a valve 1230 that is arranged to control the flow of the air out of the second air outlet 1211. To do so, the valve 1230 comprises a pair of valve members 1231 that are arranged to be moveable between a first end position in which the valve members 1231 occlude/prevent the air flow within the nozzle 1200 from reaching the second air outlet 1211 and a second end position in which the valve members 1231 allow the air flow within the nozzle 1200 to reach the second air outlet 1211. The valve 1230 is provided within the interior passage 1209 of the nozzle 1200. Consequently, each valve member 1231 is arranged to close-off the ingress end of the air outlet channel 1228 of the second air outlet 1211 from the remainder of the interior passage 1209 when in the first end position so as to substantially prevent the air flow from entering the air outlet channel 1228 of the second air outlet 1211.

Each valve member 1231 is therefore arranged so that, in the first end position, the valve member 1231 abuts/is seated against both the interior surface of the nozzle body 1203 that is adjacent to the second air outlet 1211 and the baffle wall 1227 to thereby substantially close-off the corresponding section of the opening into the air outlet channel 1228 of the second air outlet 1211 from the remainder of the interior passage 1209. Each valve member 1231 is provided with a sealing element 1232 that improves the seal formed between the valve member 1231 and the baffle wall 1227 when the valve member 1231 is in the first end position.

Figure 16:
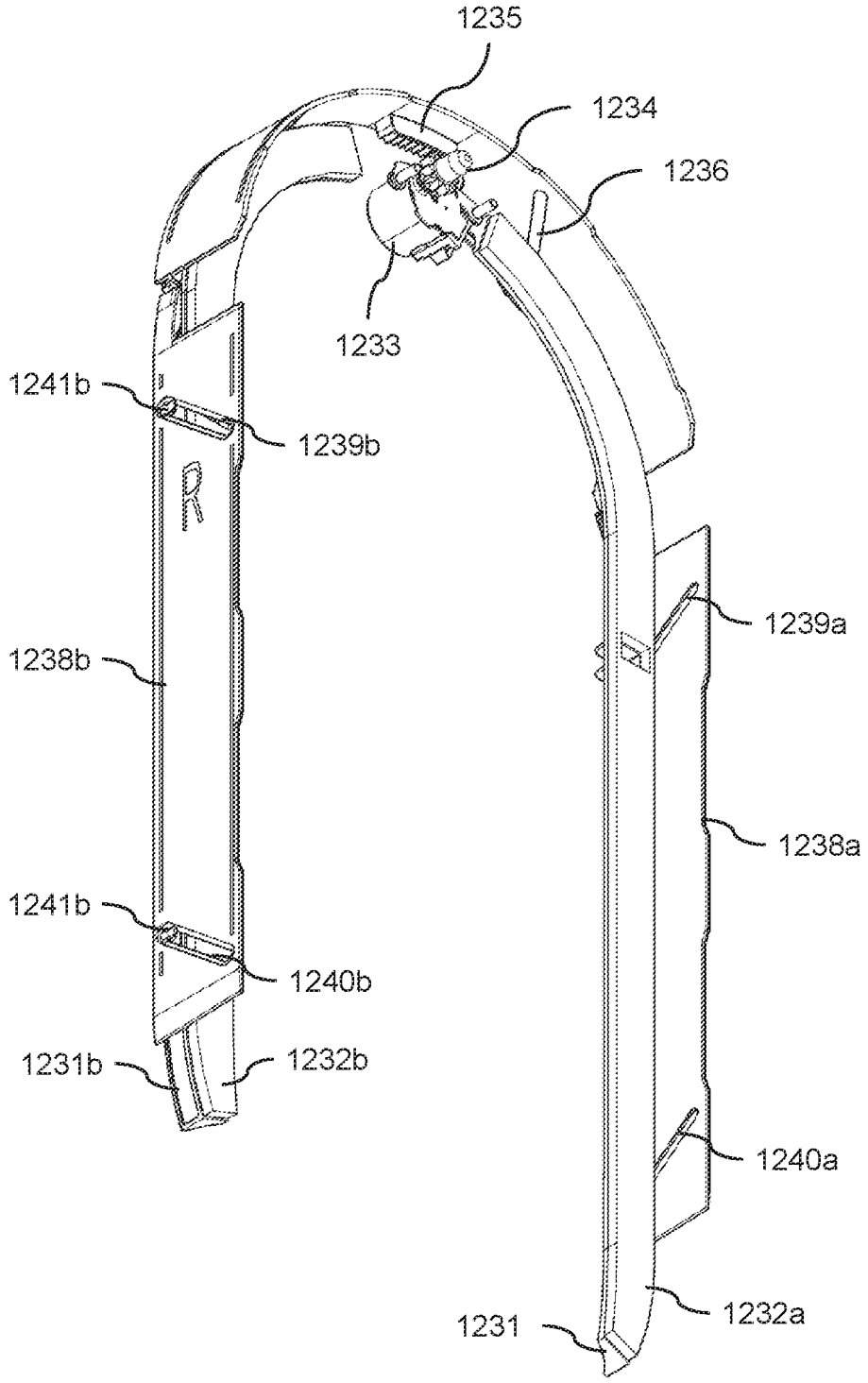
FIG. 16 is a rear perspective view of an embodiment of a valve suitable for use with the nozzle as described herein.

FIG. 16 shows a rear perspective view of an embodiment of the valve 1230 suitable with the nozzle 1200 described herein. In the illustrated embodiment, the shape of each valve member 1231 substantially corresponds to/correlates with that of the aligned section/portion of the interior passage 1209. Each valve member 1231 is therefore generally J-shaped, having an elongate section and a curved end, and also has a generally J-shaped cross-section comprising an elongate section and a curved end.

In order to move the valve members 1231 from the first end position to the second end position the fan assembly 1000 is provided with a valve motor 1233 that is arranged to cause movement of the valve members 1231 in response to signals received from the control circuits 1137. The valve motor 1233 is arranged to rotate a pinion 1234 that engages with a curved or arc-shaped rack 1235, with rotation of the valve motor 1233 causing rotation of both the pinion 1234 and the rack 1235, and with the valve 1230 being configured such that rotation of the rack 1235 results in movement of the valve members 1231.

In the illustrated embodiment, the valve motor 1233 is mounted on the baffle wall 1237 within the interior passage 1209 at the peak/centre of upper curved section 1206, with the baffle wall 1227 then being attached to the rear casing section 1225. A rotating shaft of the valve motor 1233 then projects towards the rear casing section 1225, with the axis of the rotation of the shaft being parallel to the centre axis of the bore 1204. The pinion 1234 is mounted upon the rotating shaft, with the teeth of the pinion 1234 engaging the arc-shaped rack 1235 whose shape substantially corresponds to/correlates with that of the upper curved section 1206 of the interior passage 1209.

As the nozzle body 1203 has an elongate annular shape, the rack 1235 has the shape of a minor arc wherein the rack 1235 subtends an angle that is less than 180 degrees. Specifically, the arc-shaped rack 1235 extends around the majority of the upper curved section 1206 of the interior passage 1209 defined by the nozzle body 1203, with the ends of the arc-shaped rack 1235 each being aligned with the respective elongate sides 1205 of the interior passage 1209 when mounted within the nozzle body 1203.

The openings into the air outlet channel 1228 of the second air outlet 1211 are substantially parallel to the central axis (X) of the bore 1204 of the nozzle 1200. Consequently, in order for the valve members 1231 to close off the air outlet channel 1228 of the second air outlet 1211 when in the first end position, the valve members 1231 are each arranged to move in a direction that is substantially parallel to the central axis (X) of the bore 1204. The valve 1230 is therefore configured such that the rotation of the rack 1235 is translated into movement of the valve members 1231 in a direction that is parallel to the central axis (X) of the bore 1204.

In order to translate the rotation of the rack 1235 into movement of the valve members 1231 in a direction that is parallel to the central axis (X) of the bore 1204, the arc-shaped rack 1235 is provided with a pair of surfaces that project from the rack 1235 in a direction that is parallel to the centre axis (X) of the bore 1204, with each of these projecting surfaces being curved so as to follow the curvature of the arc-shaped rack 1235, and with the rack 1235 being configured such that the pair of surfaces are located on opposite sides of the pinion 1234 when the pinion 1234 is engaged in the rack 1235. Each of these projecting surfaces is then provided with a linear cam in the form of a cam slot 1236 that extends across the curved surface at an angle of approximately 45 degrees relative to the axis of the rotation of the rack 1235, and that is arranged to be engaged by a follower pin 1237 that projects from the corresponding valve member 1231, with the cam slots 1236 provided on both of the projecting surfaces being angled in the same direction.

In addition, a first of a pair of valve actuators 1238*a* is rotatably connected/attached to a first end of the arc-shaped rack 1235 and a second of the pair of valve actuators 1238*b* is rotatably connected/attached to an opposite, second end of the arc-shaped rack 1235. Each valve actuator 1238 is elongate (being arranged to extend along the elongate sides of the interior passage 1209) and is provided with an upper cam slot 1239 provided towards the upper end of the valve actuator 1238 and a lower cam slot 1240 provided towards the lower end of the valve actuator 1238. The upper and lower cam slots 1239, 1240 extend across the corresponding valve actuator 1238 at an angle of approximately 45 degrees relative to the centre axis (X) of the bore 1204 and are each arranged to be engaged by a follower pin 1241 that projects from the corresponding valve member 1231. The cam slots 1239*a*, 1240*a* on a first of the valve actuators 1238*a* are angled upwards as the cam slots 1239*a*, 1240*a* extend from the back to the front of the valve actuator 1238*a*, whereas the cam slots 1239*b*, 1240*b* on a second of the valve actuators 1238*b* are angled downwards as the cam slots 1239*b*, 1240*b* extend from the back to the front of the valve actuator 1238*b*. Each valve member 1231 therefore comprises three follower pins 1237, 1241 that are arranged to engage with the cam slot 1236 provided on the corresponding portion of the rack 1235 and the upper and lower cam slots 1239, 1240 provided on the corresponding valve actuator 1238 respectively.

In order to move the valve members 1231 between the first end position and the second end position, the control circuits 1137 send a signal to the valve motor 1233 that causes the motor 1233 to rotate the shaft in one direction or the other, thereby causing rotation of the pinion 1234 provided on the shaft. Engagement of the pinion 1234 with the arc-shaped rack 1235 therefore causes the rack 1235 to rotate in the same direction as the shaft. Rotation of the arc-shaped rack 1235 therefore causes the angled cam slots 1236 provided on the curved surfaces that project from the rack 1235 to move relative to the follower pin 1237 of the corresponding valve member 1231 that is engaged within the cam slot 1236, with the angle of the cam slots 1236 translating the rotational movement of the arc-shaped rack 1235 into linear movement of the valve members 1231 in a direction that is parallel to the centre axis (X) of the bore 1204. In particular, rotation of the arc-shaped rack 1235 will cause both the projecting surfaces to rotate in the same direction. In this regard, as the cam slots 1236 provided on the curved surfaces that project from the rack 1235 are angled in the same direction, rotation of the curved surfaces in the same direction is translated into horizontal movement of the first valve member 1231*a* and second valve member 1231*b* in the same direction.

In addition, rotation of the arc-shaped rack 1235 results in vertical displacement of the first and second ends of the arc-shaped rack 1235 that in-turn causes vertical displacement of the valve actuators 1238 that are rotatably connected to the ends of the arc-shaped rack 1235. In particular, rotation of the arc-shaped rack 1235 will cause upwards movement of one of the first and second ends of the arc-shaped rack 1235 and the connected valve actuator 1238*a*, and downwards movement of the other of the first and second ends of the arc-shaped rack 1235 and the connected valve actuator 1238*b*. Vertical displacement of the valve actuators 1238 causes the angled cam slots 1239, 1240 provided on the valve actuators 1238 to move relative to the respective follower pins 1241 of the corresponding valve member 1231, with the angle of the cam slots 1239, 1240 translating the vertical displacement of the valve actuators 1238 into horizontal movement of the valve members 1231 in a direction that is parallel to the centre axis (X) of the bore 1204. In this regard, as the cam slots 1239*a*, 1240*a* provided on the first valve actuator 1238*a* are angled in the opposite direction to those provided on the second valve actuator 1238*b*, movement of the first valve actuator 1238*a* and the second valve actuator 1238*b* in opposing vertical directions is translated into horizontal movement of the first valve member 1231*a* and second valve member 1231*b* in the same direction.

To operate the fan assembly 1000 the user presses button on a user interface. The user interface may be provided on the fan assembly 1000 itself, on an associated remote control (not shown), and/or on a wireless computing device such as a tablet or smartphone (not shown) that communicates with the fan assembly wirelessly. This action by the user is communicated to the control circuits 1137, in response to which the control circuits 1137 activate the fan motor 1126 to rotate the impeller 1104. The rotation of the impeller 1104 causes an air flow to be drawn into the body 1100 through the air inlet 1105 via the filter assemblies 1107. The user may control the speed of the fan motor 1126, and therefore the rate at which air is drawn into the body through the air inlet 1105, by manipulating the user interface. The air flow passes sequentially through the filter assemblies 1107, air inlet 1105, the impeller housing 1109 and the air vent 1121 at the open upper end of the body 1100 of the fan assembly 1000 to enter the interior passage 1209 of the nozzle 1200 via the air inlet 1202 located in the base 1201 of the nozzle 1200.

Within the interior passage 1209, the air flow is divided into two air streams which pass in opposite angular directions around the bore 1204 of the nozzle 1200, each within a respective straight section 1205 of the interior passage

1209. As the air streams pass through the interior passage 1209, air is emitted through one or both of the first air outlets 1210 and the second air outlet 1211 in dependence upon the positions of the outlet bodies 1214 of each of the steerable first air outlets 1210 and the position of the valve members 1231 of the second air outlet 1211.

When both of the valve members 1231 provided in the interior passage 1209 are in the first end position, the elongate section of the sealing elements 1232 provided on the valve members 1231 will be in contact with the front end of the baffle wall 1227 and the overlapping portion of the inner surface of the outer casing section 1223. The valve members 1231 will therefore substantially close-off the openings into the air outlet channel 1228 of the second air outlet 1211 so as to substantially prevent the air flow from entering the air outlet channel 1228 of the second air outlet 1211. The entirety of the air flow within the nozzle 1200 will then only be able to be emitted from the nozzle 1200 via the steerable first air outlets 1210.

Figure 17:
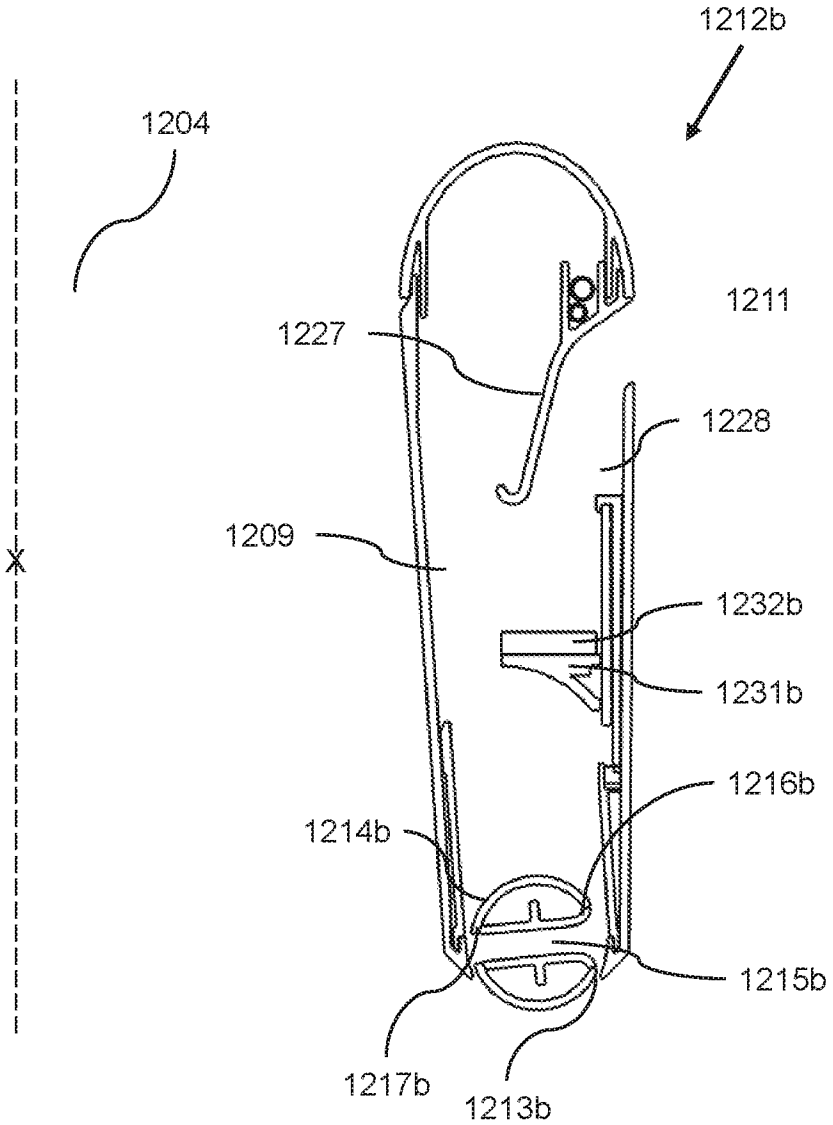
FIG. 17 is a top sectional view through the nozzle of FIG. 10 in a fifth configuration.
Figure 17:
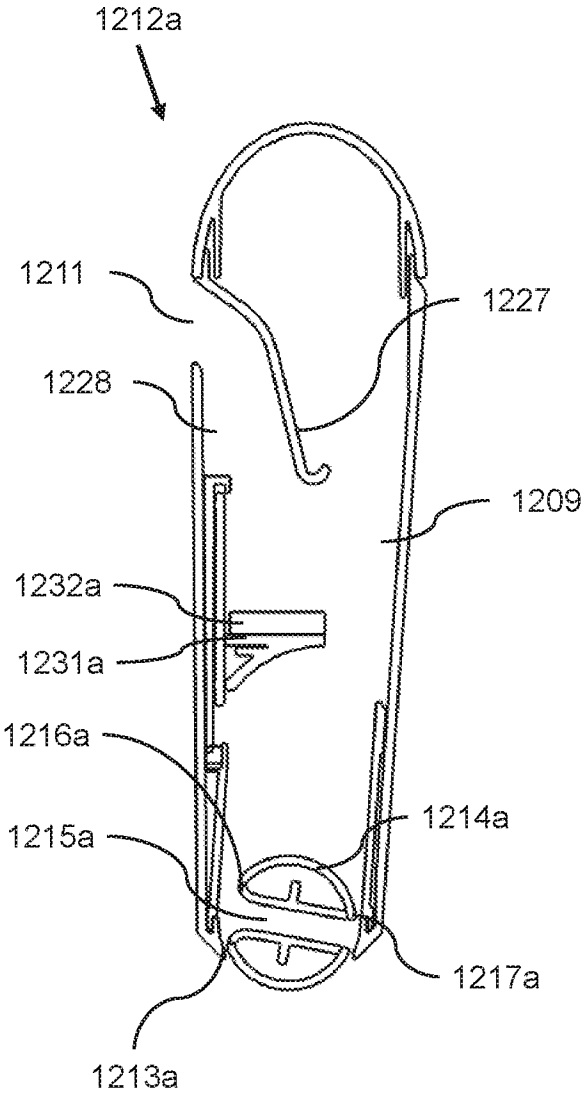

Conversely, when both of the valve members 1231 provided in the interior passage 1209 are in the second end position, the openings into the air outlet channel 1228 of the second air outlet 1211 will be open to the remainder of the interior passage 1209 so that the air flow within the nozzle 1200 can then be emitted from the nozzle 1200 via the second air outlet 1211. The control circuits 1137 can then be configured to control the steering motors 1218 of each of the steerable first air outlets 1210 to rotate the corresponding outlet body 1214 beyond one of the ends of the vectoring range so that both the ingress end 1216 and egress end 1217 of the air outlet channel 1215 of the outlet body 1214 are disposed within the interior of the corresponding outlet section 1212. Doing so closes-off the steerable first air outlets 1210 as any that passes through the air outlet channel 1215 of the corresponding outlet body 1214 will remain within the interior of the nozzle 1200 and will not be emitted from the nozzle 1200. The entirety of the air flow within the nozzle 1200 will then only be able to be emitted from the nozzle 1200 via the second air outlet 1211. FIG. 17 therefore shows a top cross-sectional view through the nozzle 1200 of FIG. 10 in which the valve 1230 is open and in which the outlet bodies 1214 are arranged such that the steerable first air outlets 1210 are closed.

It will be appreciated that individual items described above may be used on their own or in combination with other items shown in the drawings or described in the description and that items mentioned in the same passage as each other or the same drawing as each other need not be used in combination with each other. In addition, the expression "means" may be replaced by actuator or system or device as may be desirable. In addition, any reference to "comprising" or "consisting" is not intended to be limiting in any way whatsoever and the reader should interpret the description and claims accordingly.

Furthermore, although the invention has been described in terms of preferred embodiments as set forth above, it should be understood that these embodiments are illustrative only. Those skilled in the art will be able to make modifications and alternatives in view of the disclosure which are contemplated as falling within the scope of the appended claims. For example, those skilled in the art will appreciate that the above-described invention might be equally applicable to other types of environmental control fan assemblies, and not just free standing fan assemblies. By way of example, such a fan assembly could be any of a freestanding fan assembly, a ceiling or wall mounted fan assembly and an in-vehicle fan assembly.

In addition, whilst the above described embodiments all provide a valve motor for driving the movement of the valve member of the valve, the nozzles described herein could alternatively include a manual mechanism for driving the movement of the valve member, wherein the application of a force by the user would be translated into movement of the valve member. For example, this could take the form of a rotatable dial or wheel or a sliding dial or switch, with rotation or sliding of the dial by a user causing rotation of the shaft, pinion and rack.

Furthermore, in the above described embodiments the steerable air outlets each comprise an outlet body that is generally cylindrical, and therefore has a circular cross-section. However, the steerable air outlets could each comprise an outlet body that is only partially cylindrical, with the cylindrical portion being sufficient to allow the outlet body to rotate within the corresponding opening. For example, the outlet body of the steerable air outlets could have a cross-sectional shape of a truncated circle, a circular sector, a teardrop etc. In addition, whilst in the above described embodiments the air outlet channel passing through the outlet body of the steerable air outlets is straight and extends diametrically through the outlet body, the air outlet channel could be curved, angled relative to or offset from the diameter of the outlet body.

The invention claimed is:

1. A fan assembly comprising:

an air flow generator that is arranged to generate an air flow; and a nozzle arranged to emit the air flow from the fan assembly, the nozzle comprising:

a nozzle body, and a plurality of steerable air outlets that are each arranged to emit a portion of the air flow, wherein each of the steerable air outlets comprises:

an opening within a corresponding outlet section of the nozzle body, and an elongate outlet body that is arranged to occlude the opening and that is arranged to rotate within the opening around a longitudinal axis of the outlet body, and wherein each outlet body is provided with an air outlet channel that extends through a width of the outlet body.

2. The fan assembly of claim 1, wherein the plurality of steerable air outlets are arranged to be independently rotated relative to the nozzle body.

3. The fan assembly of claim 1, wherein each outlet body has an at least partially circular cross-section, and preferably is cylindrical in shape.

4. The fan assembly of claim 1, wherein the air outlet channel of each outlet body is straight and extends diametrically through the outlet body.

5. The fan assembly of claim 1, wherein each of the steerable air outlets further comprises a steering motor that is arranged to rotate the corresponding outlet body.

6. The fan assembly of claim 5, and further comprising a control circuit that is arranged to control the steerable air outlets, wherein the control circuit is arranged to independently control each steering motor.

7. The fan assembly of claim 1, wherein each of the steerable air outlets further comprises an outlet body orientation detection system that is arranged to detect the orientation of the outlet body relative to the nozzle body.

8. The fan assembly of claim 7, wherein the outlet body orientation detection system is arranged to detect which one of two portions of a vectoring range the outlet body is currently in.

9. The fan assembly of claim 8, wherein the outlet body orientation detection system comprises a photo-interrupter provided on the nozzle body and a screen that is arranged to be detected by the photo-interrupter when the outlet body is in one of the two portions of the vectoring range.

10. The fan assembly of claim 1, wherein the nozzle body comprises a casing that defines the outlet section of each of the steerable air outlets.

11. The fan assembly of claim 10, wherein each outlet section comprises an interior passage that is defined by the casing and that is arranged to convey air from an air inlet of the nozzle to the steerable air outlet.

12. The fan assembly of claim 1, wherein the nozzle comprises a first steerable air outlet and a second steerable air outlet.

13. The fan assembly of claim 12, wherein the nozzle body comprises a first outlet section that provides the first steerable air outlet and a second outlet section that provides the second steerable air outlet.

14. The fan assembly of claim 13, wherein the first steerable air outlet comprises a first opening defined by the first outlet section and a first outlet body that is disposed within the first opening and that is arranged to rotate within the first opening, and the second steerable air outlet comprises a second opening defined by the second outlet section and a second outlet body that is disposed within the second opening and that is arranged to rotate within the second opening.

15. The fan assembly of claim 12, wherein the nozzle body has an elongate annular shape and the first and second steerable air outlets are each located on a respective elongate side of the nozzle body.

16. A nozzle for a fan assembly, the nozzle comprising:

an air inlet for receiving an air flow from the fan assembly;

a nozzle body, and a plurality of steerable air outlets that are each arranged to emit a portion of the air flow, wherein each of the steerable air outlets comprises:

an opening within a corresponding outlet section of the nozzle body, and an elongate outlet body that is arranged to occlude the opening and that is arranged to rotate within the opening around a longitudinal axis of the outlet body, and wherein each outlet body is provided with an air outlet channel that extends through a width of the outlet body.

* * * * *